US012628994B2

(12) United States Patent
Choi et al.

(10) Patent No.: US 12,628,994 B2
(45) Date of Patent: May 19, 2026

(54) CLEANING APPARATUS INCLUDING ROBOT CLEANER AND DOCKING STATION, AND CONTROL METHOD THEREFOR

(71) Applicant: SAMSUNG ELECTRONICS CO., LTD., Suwon-si (KR)

(72) Inventors: Ingyu Choi, Suwon-si (KR); Hyunju Lee, Suwon-si (KR); Seehyun Kim, Suwon-si (KR); Shin Kim, Suwon-si (KR); Sanghyuk Park, Suwon-si (KR); Heesuk Yoon, Suwon-si (KR); Seungryong Cha, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 446 days.

(21) Appl. No.: 18/137,274

(22) Filed: Apr. 20, 2023

(65) Prior Publication Data

US 2023/0255418 A1 Aug. 17, 2023

Related U.S. Application Data

(63) Continuation of application No. PCT/KR2021/013535, filed on Oct. 1, 2021.

(30) Foreign Application Priority Data

Nov. 24, 2020 (KR) ..... 10-2020-0159377

(51) Int. Cl.
*A47L 9/14* (2006.01)
*A47L 9/00* (2006.01)
*A47L 9/28* (2006.01)

(52) U.S. Cl.
CPC ..... *A47L 9/149* (2013.01); *A47L 9/0063* (2013.01); *A47L 9/1409* (2013.01); *A47L 9/281* (2013.01);

(Continued)

(58) Field of Classification Search
CPC .... A47L 9/2842; A47L 9/2873; A47L 9/2894; A47L 2201/024; A47L 9/149; A47L 9/0063; A47L 9/1409; A47L 9/281
See application file for complete search history.

(56) References Cited

U.S. PATENT DOCUMENTS 8,572,799 B2 * 11/2013 Won ..... A47L 11/4002 15/352
8,635,739 B2 * 1/2014 Lee ..... A47L 9/20 15/352

(Continued)

FOREIGN PATENT DOCUMENTS

JP 2003-180587 7/2003
JP 2007181656 A * 7/2007 ..... A47L 9/2884

(Continued)

OTHER PUBLICATIONS

KR 20120113188 A—English Machine Translation (Year: 2012).*

(Continued)

*Primary Examiner* — Marc Carlson
(74) *Attorney, Agent, or Firm* — STAAS & HALSEY LLP

(57) ABSTRACT

A cleaning apparatus comprises: a robot cleaner including a dust collection canister and a first suction device; and a docking station including a second suction device, which communicates with the dust container to suck air including foreign substances from the dust container in response to the robot cleaner being coupled to the docking station, and a trapping portion to capture the foreign substances included in the sucked air. The robot cleaner includes: a communication unit; and a control unit to control the first suction device in response to the robot cleaner being coupled to the docking station, controlling the communication unit to transmit a control command to the docking station, and periodi- (Continued)

cally changing the suction force of either the first suction device and the second suction device.

15 Claims, 22 Drawing Sheets

(52) U.S. Cl.
CPC ..... *A47L 9/2842* (2013.01); *A47L 9/2873* (2013.01); *A47L 9/2894* (2013.01); *A47L 2201/022* (2013.01); *A47L 2201/024* (2013.01); *A47L 2201/04* (2013.01)

(56) References Cited

U.S. PATENT DOCUMENTS

| | | | | |
|---|---|---|---|---|
| 8,756,751 | B2 * | 6/2014 | Jung | A47L 9/2815 15/319 |
| 9,241,602 | B2 | 1/2016 | Lee et al. | |
| 10,456,002 | B2 * | 10/2019 | Amaral | A47L 9/0477 |
| 11,304,576 | B2 * | 4/2022 | Jeong | A47L 9/106 |
| 11,337,573 | B2 * | 5/2022 | Kim | A47L 9/106 |
| 2012/0060320 | A1 * | 3/2012 | Lee | A47L 9/20 15/347 |
| 2018/0199776 | A1 * | 7/2018 | Sato | A47L 9/1641 |
| 2020/0138255 | A1 * | 5/2020 | Sato | A47L 9/0063 |
| 2020/0187736 | A1 * | 6/2020 | Jeong | A47L 9/2873 |
| 2021/0298550 | A1 * | 9/2021 | Kim | A47L 9/0009 |

FOREIGN PATENT DOCUMENTS

| | | | | |
|---|---|---|---|---|
| JP | 3986310 | | 10/2007 | |
| JP | 2019-217205 | | 12/2019 | |
| JP | 6636320 | | 1/2020 | |
| JP | 6664230 | | 3/2020 | |
| KR | 97-32723 | | 7/1997 | |
| KR | 10-2005-0035653 | | 4/2005 | |
| KR | 20080079075 | A * | 8/2008 | A47L 9/106 |
| KR | 10-2011-0041721 | | 4/2011 | |
| KR | 20120113188 | A * | 10/2012 | A47L 9/2842 |
| KR | 10-1330734 | | 11/2013 | |
| KR | 10-1467341 | | 12/2014 | |
| KR | 10-1483541 | | 1/2015 | |
| KR | 10-1970584 | | 8/2019 | |
| KR | 10-2019-0126171 | | 11/2019 | |
| KR | 10-2058867 | | 12/2019 | |
| KR | 10-2020-0073677 | | 6/2020 | |
| KR | 10-2020-0073966 | | 6/2020 | |
| KR | 10-2020-0074054 | | 6/2020 | |
| KR | 20200090569 | A * | 7/2020 | A47L 9/2873 |
| KR | 4 005 452 | A1 | 6/2022 | |

OTHER PUBLICATIONS

Written Opinion Report dated Jan. 10, 20022 issued in PCT/KR2021/013535.

Korean Office Action dated Dec. 2, 2025 for Korean Application No. 10-2020-0159377.

* cited by examiner

CLEANING APPARATUS INCLUDING ROBOT CLEANER AND DOCKING STATION, AND CONTROL METHOD THEREFOR

CROSS-REFERENCE TO RELATED APPLICATIONS

This application is a continuation application, under 35 U.S.C. § 111(a), of International Patent Application No. PCT/KR2021/013535, filed on Oct. 1, 2021, which claims the priority benefit of Korean Patent Application No. 10-2020-0159377, filed on Nov. 24, 2020, in the Korean Patent and Trademark Office, the disclosure of which is hereby incorporated by reference in it entirety.

BACKGROUND

Field

The disclosure relates to a cleaning apparatus including a robot cleaner and a docking station.

Description of the Related Art

In general, a robot cleaner is a device that automatically cleans a cleaning space by suctioning foreign substances, such as foreign substances accumulated on the floor, while moving the cleaning space without a user's manipulation. The robot cleaner cleans the cleaning space while travelling in the cleaning space.

The robot cleaner identifies the distance to obstacles, such as furniture, office supplies, and walls installed in a cleaning zone through a distance sensor, and selectively drives a left motor and a right motor of the robot cleaner to change directions while cleaning the cleaning area.

The robot cleaner, which cleans the floor using a dust collecting device, may include a dust collection chamber. Foreign substances collected in the dust collection chamber may be manually emptied by the user or automatically emptied by a gathering device provided in a docking station.

SUMMARY

A cleaning apparatus according to an embodiment includes: a robot cleaner including a dust container and a first suction device; and a docking station including a second suction device configured to, upon the robot cleaner being coupled thereto, communicate with the dust container and suction air, and a trapping portion configured to capture foreign substances moving together with the air by the second suction device being driven, wherein the robot cleaner includes: a communicator; and a controller configured to, upon the robot cleaning being coupled to the docking station, control the first suction device and control the communicator to transmit a control command to the docking station such that a suction force of at least one of the first suction device or the second suction device is periodically changed.

The controller may be configured to, upon the robot cleaner being coupled to the docking station, control the communicator to transmit a control command for the second suction device to operate for a first period of time to the docking station.

The controller may be configured to, after the operation of the second suction device for the first period of time, periodically change the suction force of the at least one of the first suction device or the second suction device.

The controller may be configured to control the first suction device such that the first suction device may operate for a second period of time after periodically changing the suction force of the at least one of the first suction device or the second suction device.

The controller may be configured to periodically change the suction force of each of the first suction device and the second suction device such that the first suction device and the second suction device may operate alternately with each other.

The controller may be configured to periodically change the suction force of the second suction device while the first suction device may be in a stopped state.

The controller may be configured to periodically change the suction force of the second suction device while the first suction device may be continuously turned on.

The controller may be configured to periodically change the suction force of the first suction device while the second suction device may be continuously turned on.

The robot cleaner may include a dust container door provided to open and close the dust container, and the docking station may include a lever device configured to open the dust container door to allow the dust container to communicate with the second suction device.

The controller may be configured to, upon the robot cleaner being coupled to the docking station, control the communicator to transmit a control command for the lever device to open the dust container door to the docking station.

The controller may be configured to control the communicator to transmit, to the docking station, a control command for the lever device to close the dust container door after periodically changing of the suction force of the at least one of the first suction device or the second suction device.

The robot cleaner may further include a dust container sensor configured to measure an amount of foreign substances collected in the dust container, wherein the controller may be configured to, upon determining that the amount of the foreign substances collected in the dust container reaching a preset amount based on an output of the dust container sensor, allow the robot cleaner to move to the docking station.

A method according to an embodiment, which is a method of controlling a cleaning apparatus including a robot cleaner including a dust container and a first suction device, and a docking station including a second suction device configured to, upon the robot cleaner being coupled thereto, communicate with the dust container and suction air, includes: upon the robot cleaner being coupled to the docking station, controlling the first suction device; and controlling the robot cleaner to transmit a control command to the docking station such that a suction force of at least one of the first suction device or the second suction device is periodically changed.

The method may further include, upon the robot cleaner being coupled to the docking station, controlling the robot cleaner to transmit a control command for the second suction device to operate for a first period of time to the docking station.

The periodical changing of the suction force of the at least one of the first suction device or the second suction device may include, after the second suction device operates for the first period of time, periodically changing the suction force of the at least one of the first suction device or the second suction device.

The method may further include controlling the first suction device such that the first suction device may operate for a second period of time after periodically changing of the suction force of the at least one of the first suction device or the second suction device.

The periodical changing of the suction force of the at least one of the first suction device or the second suction device may include periodically change the suction force of each of the first suction device and the second suction device such that the first suction device and the second suction device may operate alternately with each other.

The periodical changing of the suction force of the at least one of the first suction device or the second suction device may include periodically changing the suction force of the second suction device in a state in which the first suction device may be stopped.

The periodical changing of the suction force of the at least one of the first suction device or the second suction device may include periodically changing the suction force of the second suction device in a state in which the first suction device may be continuously powered on.

The periodical changing of the suction force of the at least one of the first suction device or the second suction device may include periodically changing the suction force of the first suction device in a state in which the second suction device may be continuously powered on.

The robot cleaner may include a dust container door provided to open and close the dust container, and the docking station may include a lever device configured to open the dust container door to allow the dust container to communicate with the second suction device.

The method may further include, upon the robot cleaner being coupled to the docking station, controlling the robot cleaner to transmit a control command for the lever device to open the dust container door to the docking station.

The method may further include controlling the robot cleaner to transmit, to the docking station, a control command for the lever device to close the dust container door after periodically changing the suction force of the at least one of the first suction device or the second suction device.

The robot cleaner may further include a dust container sensor configured to measure an amount of foreign substances collected in the dust container, wherein the method may further include, upon determining that the amount of the foreign substances collected in the dust container reaching a preset amount based on an output of the dust container sensor, allowing the robot cleaner to move to the docking station.

DETAILED DESCRIPTION

Figure 1:
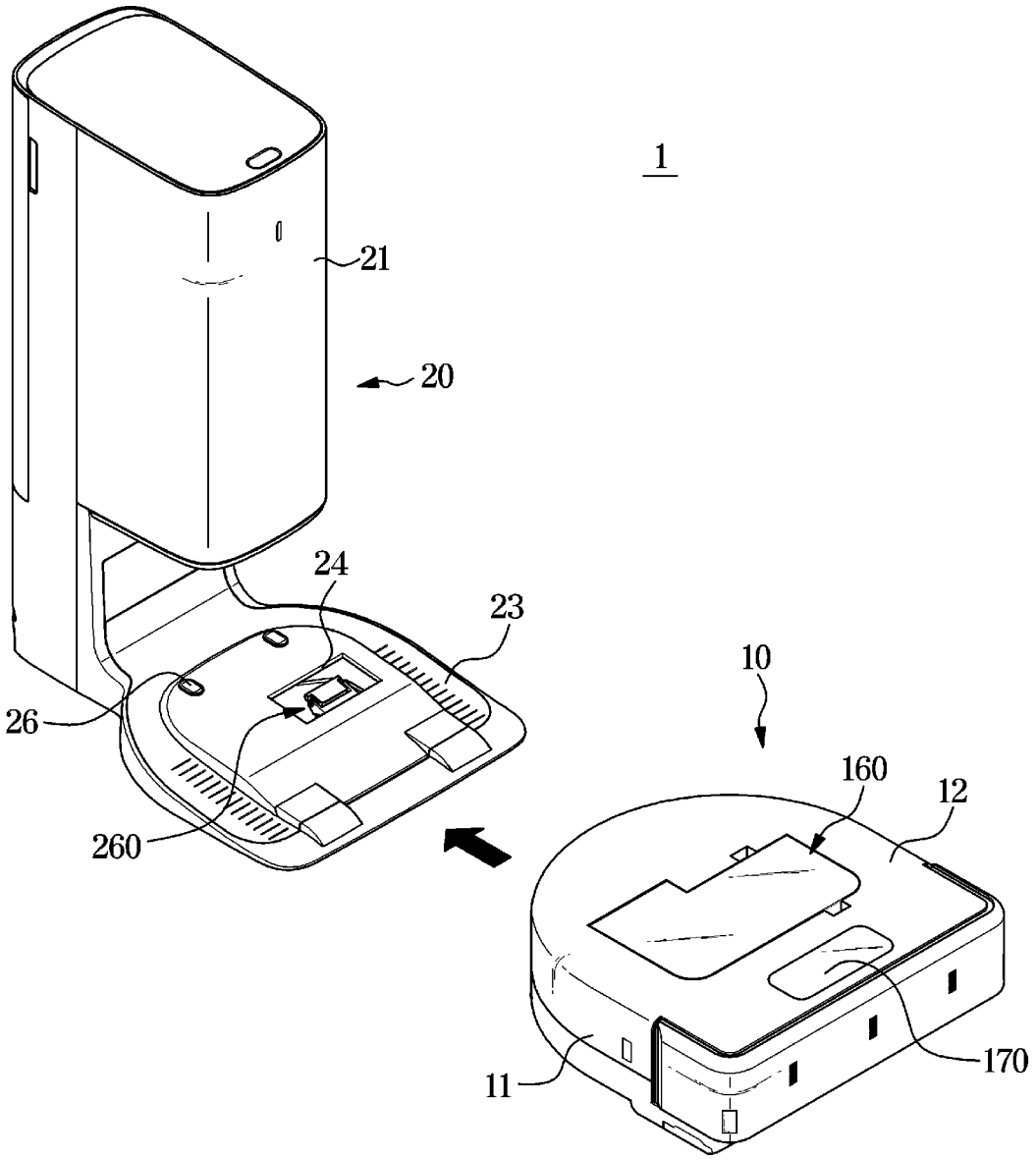
FIG. 1 is a view illustrating the external appearance of a cleaning apparatus according to an embodiment.

The embodiments described in the present specification and the configurations shown in the drawings are only examples of preferred embodiments of the present disclosure, and various modifications may be made at the time of filing of the present disclosure to replace the embodiments and drawings of the present specification.

It will be further understood that the term "connect" or its derivatives refer both to direct and indirect connection, and the indirect connection includes a connection over a wireless communication network.

The terms used herein are for the purpose of describing the embodiments and are not intended to restrict and/or to limit the present disclosure. For example, the singular expressions herein may include plural expressions, unless the context clearly dictates otherwise. Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another. For example, without departing from the scope of the present disclosure, the first component may be referred to as a second component, and similarly, the second component may also be referred to as a first component.

The terms, such as "— part", "—device", "—block", "—member", "— module", and the like may refer to a unit for processing at least one function or act. For example, the terms may refer to at least process processed by at least one hardware, such as field-programmable gate array (FPGA)/application specific integrated circuit (ASIC), software stored in memories, or processors.

Reference numerals used for method steps are just used for convenience of explanation, but not to limit an order of the steps. Thus, unless the context clearly dictates otherwise, the written order may be practiced otherwise.

Hereinafter, embodiments according to the disclosure will be described in detail with reference to the accompanying drawings.

Provided is a cleaning apparatus in which the suction force of at least one of a suction device of a robot cleaner or a suction device of a docking station is periodically changed to efficiently discharge foreign substances collected in the robot cleaner, and foreign substances remaining in a discharge port after discharge of foreign substances are suctioned to prevent the suction force of the robot cleaner from being reduced while preventing a user to feel displeasure.

With a cleaning apparatus according to an embodiment, the suction force of at least one of a suction device of a robot cleaner or a suction device of a docking station is periodically changed so that foreign substances collected in the robot cleaner can be efficiently discharged, and foreign substances remaining in a discharge port after discharge of foreign substances are suctioned so that the suction force of the robot cleaner can be prevented from being reduced while preventing a user to feel displeasure.

Figure 2:
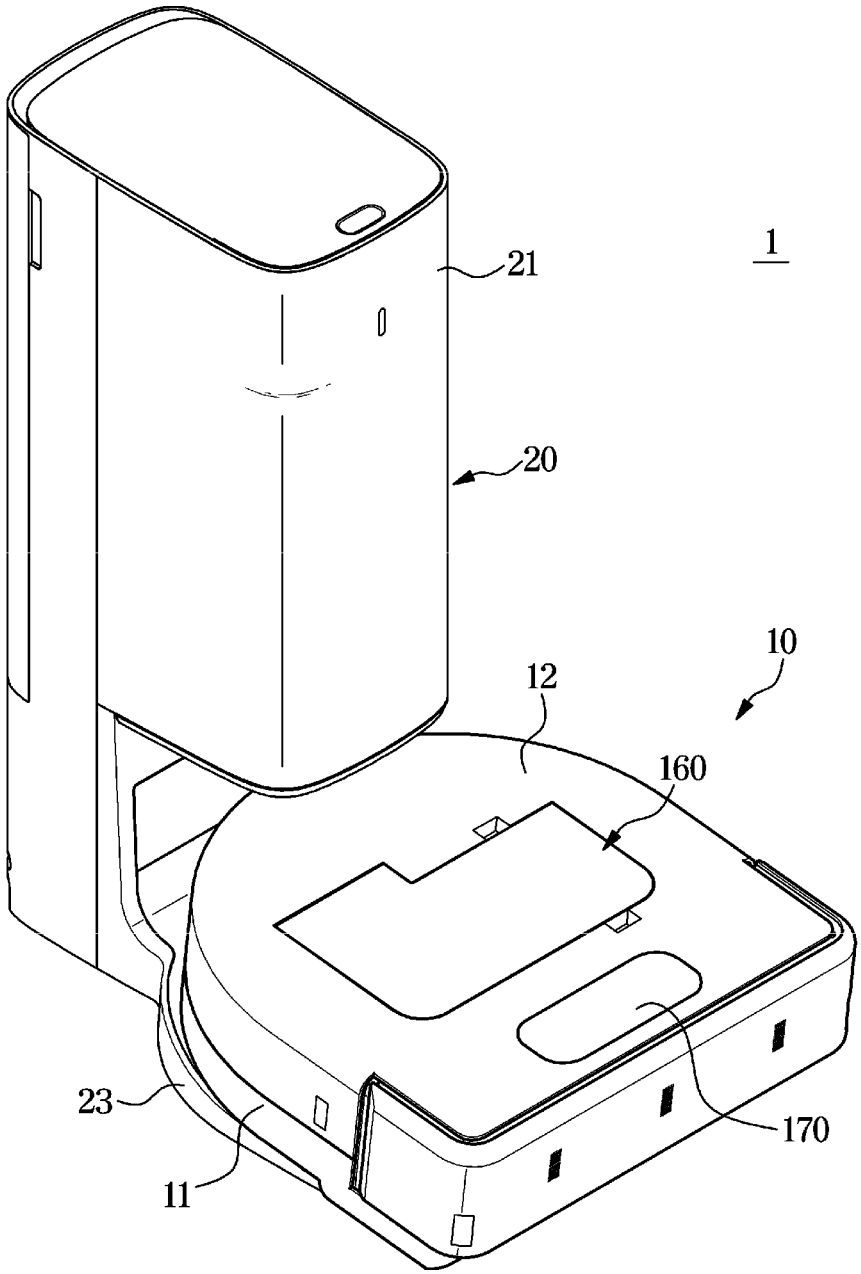
FIG. 2 is a view illustrating a state in which a robot cleaner of a cleaning apparatus according to an embodiment is seated on a docking station.
Figure 3:
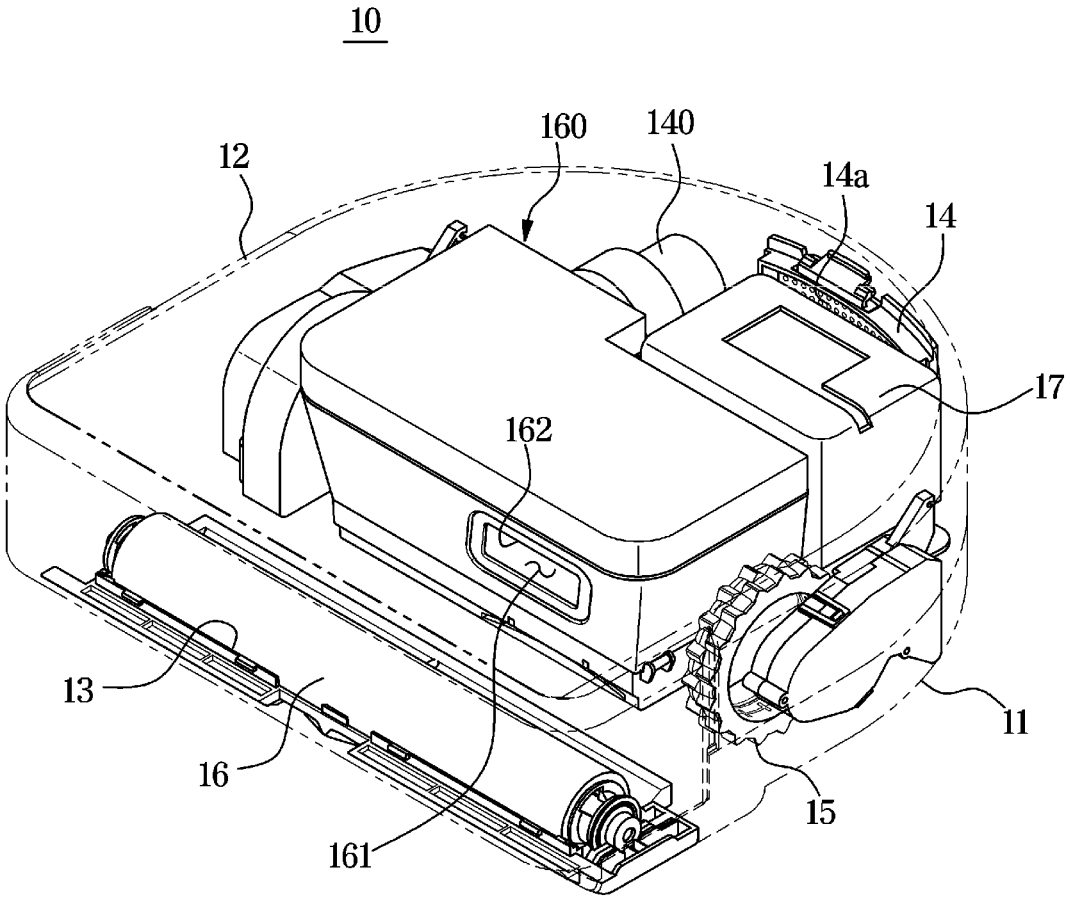
FIG. 3 is a view illustrating an inside of a robot cleaner according to an embodiment.
Figure 4:
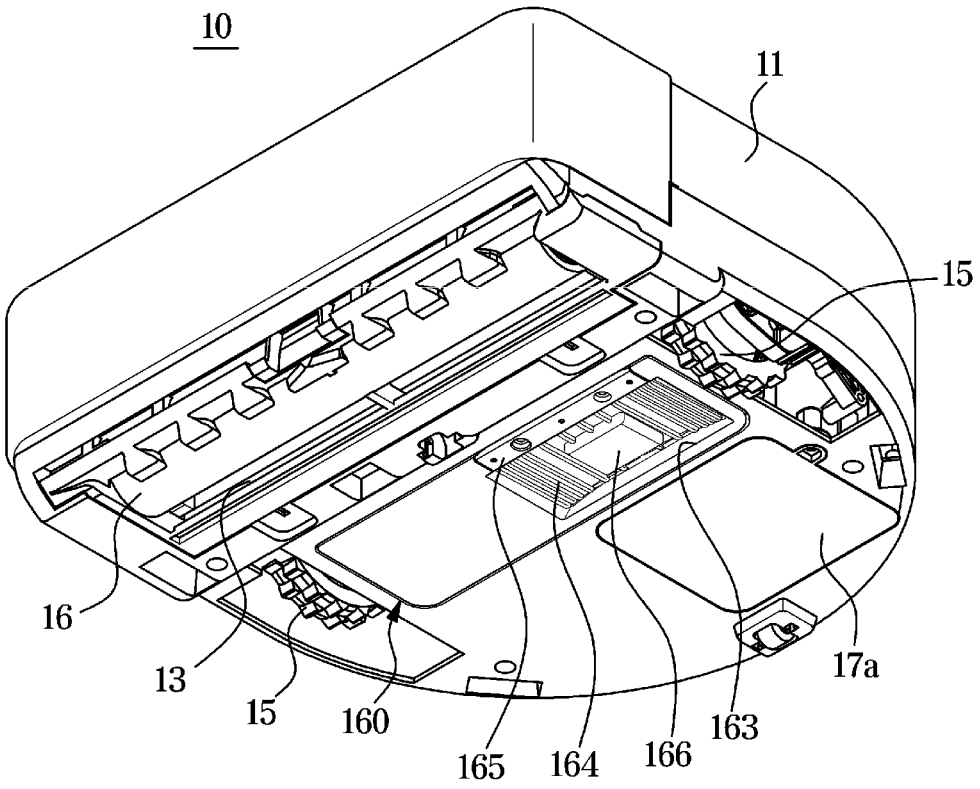
FIG. 4 is a view illustrating a lower side of a robot cleaner according to an embodiment.
Figure 5:
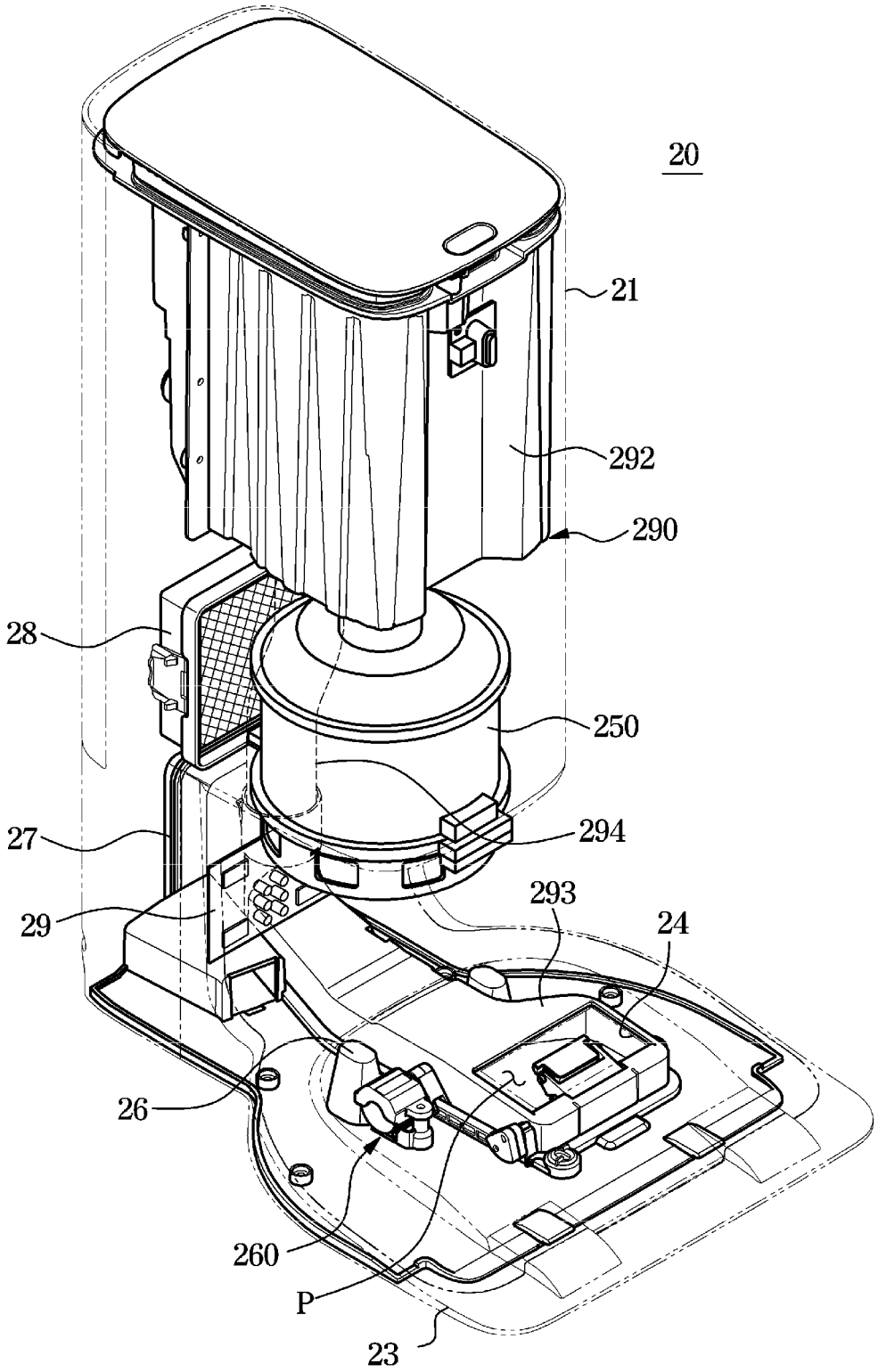
FIG. 5 is a view illustrating an inside of a docking station according to an embodiment.

FIG. 1 is a view illustrating the external appearance of a cleaning apparatus according to an embodiment, FIG. 2 is a view illustrating a state in which a robot cleaner of a cleaning apparatus according to an embodiment is seated on a docking station, FIG. 3 is a view illustrating an inside of a robot cleaner according to an embodiment, FIG. 4 is a view illustrating a lower side of a robot cleaner according to an embodiment, and FIG. 5 is a view illustrating an inside of a docking station according to an embodiment.

Referring to FIGS. 1 and 2, a cleaning apparatus 1 may include a robot cleaner 10 and a docking station 20.

The robot cleaner 10 may clean a floor surface while moving along the floor surface. The floor surface cleaned by the robot cleaner 10 may be referred to as a surface to be cleaned. The robot cleaner 10 may move to the docking station 20 as shown in FIG. 2 when it needs charging or when a dust container is filled with foreign substances and needs to be emptied.

The docking station 20 may be provided to mount the robot cleaner 10 thereon. The docking station 20 may include a cleaner seating portion 23 on which the robot cleaner 10 is seated. While the robot cleaner 10 is seated on the cleaner seating portion 23, the docking station 20 may charge a battery of the robot cleaner 10 or collect foreign substances collected in the dust container of the robot cleaner 10 seating portion 23.

The cleaner seating portion 23 may be provided with a connection opening 24 that is connected to one end of a guide member capable of communicating with the dust container of the robot cleaner 10, the connection opening 24 formed to allow a gathering passage with the outside.

Referring to FIGS. 3 and 4, the robot cleaner 10 may include a cleaner housing 11 having an accommodation space formed therein, and a cleaner cover 12 covering an open upper side of the cleaner housing 11. Electrical components may be disposed inside the cleaner housing 11. The cleaner cover 12 may be detachably coupled to the cleaner housing 11.

The cleaner housing 11 may be provided with a cleaner inlet 13. The cleaner inlet 13 may be formed toward the surface to be cleaned. The cleaner inlet 13 may be formed by passing through a bottom surface of the cleaner housing 11. Foreign substances on the surface to be cleaned may be introduced into a dust collecting device 160 together with air through the cleaner inlet 13.

A drum blade 16 may be disposed on the cleaner inlet 13. The drum blade 16 may be mounted to be rotatable with respect to the cleaner housing 11. The drum blade 16 may strike the surface to be cleaned and disperse foreign substances. The dispersed foreign substances may be introduced into the cleaner inlet 13 together with surrounding air.

The foreign substances and/or air introduced through the cleaner inlet 13 may be transported to the dust collecting device 160. Specifically, foreign substances and/or air may be transported to the dust container 161 through a foreign substance inlet 162.

The cleaner housing 11 may be provided with a cleaner discharge portion 14. The cleaner discharge portion 14 may be arranged on a rear side of the robot cleaner 10. The cleaner discharge portion 14 may discharge air, which is introduced through the cleaner inlet 13 by a suction force generated by a first suction device 140, to the outside of the robot cleaner 10. The cleaner discharge portion 14 may include a cleaner outlet 14*a* that is provided as a plurality of through holes.

The robot cleaner 10 may include a cleaner wheel 5. The cleaner wheel 15 may move the robot cleaner 10. The cleaner wheel 15 may rotate by receiving power from a wheel driving device (not shown). Although the cleaner wheels 15 are illustrated as being provided on the left and right sides of the robot cleaner 10, the positions of the cleaner wheels 15 are not limited thereto.

The robot cleaner 10 may include a battery 17. The battery 17 may be provided to be rechargeable. The battery 17 may provide power required for driving of the robot cleaner 10.

A battery cover 17*a* may be detachably mounted on a bottom surface of the cleaner housing 11. As the battery cover 17*a* is separated from the cleaner housing 11, the battery 17 may be separated from the robot cleaner 10.

The robot cleaner 10 may include a first suction device 140. The first suction device 140 may be provided as a fan motor device. The first suction device 140 may generate a suction force for suctioning foreign substances and/or air from the surface to be cleaned through the cleaner inlet 13. The first suction device 140 may be disposed to communicate with an air outlet (not shown) of the dust collecting device 160. The first suction device 140 may be disposed on an air passage between the cleaner inlet 13 and the cleaner discharge portion 14.

In addition, the first suction device 140 according to embodiments may, upon the robot cleaner 10 being coupled to the docking station 20 and a discharge process being performed to discharge foreign substances collected in the dust container 161 to the docking station 20, operate while periodically changing the suction force. With such a configuration, the internal pressure of the dust container 161 fluctuates, so that foreign substances in the dust container 161 may be discharged more efficiently. In this case, periodically changing the suction force of the first suction device 140 may include periodically turning on or off the first suction device 140 or periodically changing the rotational speed of the first suction device 140. In other words, the robot cleaner 10 periodically repeats an operation of supplying power to the first suction device 140 and cutting off power to the first suction device 140 such that the first suction device 140 is periodically turned on and off, or periodically repeats an operation of supplying high power to the first suction device 140 for a certain period of time and then supplying low power to the first suction device 140 for a certain period of time such that the rotational speed of the first suction device 140 is periodically changed, thereby allowing the suction force of the first suction device 140 to be periodically changed.

Specifically, when the suction device of the docking station 20 is continuously turned on and the same intake airflow is supplied to the dust container 161, some of the foreign substances may be caught with internal components of the dust container 161 and may not be discharged to the outside. For example, foreign substances, such as hair, may be caught with internal components of the dust container 161 and despite the intake airflow, remain inside the dust container 161 without being separated from the outside of the dust container 161. That is, the intake airflow delivered to the inside of the dust container 161 may be formed to be directed only in the same direction. Accordingly, some foreign substances may have a resistance to the direction in which the intake airflow is formed, and thus may not escape to the outside of the dust container 161 by the intake airflow. Therefore, foreign substances inside the dust container 161 may not be effectively discharged.

Accordingly, the cleaning apparatus 1 may periodically change the suction force of at least one of the first suction device 140 of the robot cleaner 10 or the suction device of the docking station 20 while the discharge process is being performed to cause a change in the intake airflow, to change the flow rate inside the dust container 161, thereby varying the flow of air inside the dust container 161. As the internal pressure of the dust container 161 fluctuates, foreign substances in the dust container 161 may be discharged more efficiently.

In addition, the first suction device 140 according to embodiments is provided to, after a suction force of at least one of the first suction device 140 of the robot cleaner 10 or the suction device of the docking station 20 is periodically changed to change the intake airflow, operate for a preset period of time such that foreign substances remaining between the dust container 161 and the dust container door that opens and closes the dust container 161 are suctioned back to the dust container 161. That is, the first suction device 140 may be continuously powered on for a preset period of time before the end of the discharge process. With such a configuration, deterioration of sealing of the dust container 161 that may occur due to foreign substances remaining between the dust container 161 and the dust container door may be prevented, thus preventing air from flowing through a region between the dust container 161 and the dust container door and finally preventing the suction force of the robot cleaner 10 from being reduced. In addition, foreign substances (e.g., hair) remaining between the dust container 161 and the dust container door may be prevented from being exposed to the outside of the robot cleaner 10, thereby preventing a user from feeling displeasure. The operation of the first suction device 140 during the discharge process will be described in detail below.

The dust collecting device 160 may be configured to filter out and collect foreign substances introduced through the cleaner inlet 13. The dust collecting device 160 may include a dust container 161 in which foreign substances are collected, a foreign substance inlet 162 into which foreign substances and/or air are introduced, a foreign substance outlet 163 through which foreign substances are discharged to the docking station 20, a dust container door 164 for opening and closing the foreign substance outlet 163, a door support 165 for supporting the dust container door 164, and a door magnetic body 166 provided in the dust container door 164. That is, the dust container 161 may include the foreign substance inlet 162, the foreign substance outlet 163, and the dust container door 164, and the dust container door 164 may open or close the foreign substance outlet 163, thereby opening or closing the dust container 161.

Foreign substances separated from air containing the foreign substances suctioned by the robot cleaner 10 may be collected in the dust container 161. The dust container 161 may communicate with the outside through the foreign substance outlet 163. A device for separating foreign substances from air may be disposed in the dust container 161. A cyclone unit (not shown) may be disposed in the dust container 161.

The foreign substance outlet 163 may be opened and closed by the dust container door 164. The foreign substance outlet 163 may be formed on the bottom surface of the dust container 161. The foreign substance outlet 163 may selectively communicate with the connection opening 24 of the station 20.

The dust container door 164 may open or close the foreign substance outlet 163 by rotating with respect to the dust collecting device 160. The dust container door 164 may have one end fixed to the door support 165 that is provided on a lower side of the dust collecting device 160.

The dust container door 164 may include a material having elasticity. The dust container door 164 may be elastically biased in a direction of the foreign substance outlet 163 being closed by the elasticity. The door support 165 may support the one end of the dust container door 164 such that the dust container door 164 is kept in a position closing the foreign substance outlet 163.

The door magnetic body 166 may include a magnet. The door magnetic body 166 may be provided to correspond to a lever magnetic body of the lever device 260 of the docking station 20 that opens the dust container door 164. The door magnetic body 166 may be provided such that attractive force is exerted between the door magnetic body 166 and the lever magnetic body. The door magnetic body 166 may be located at a substantially central portion of the dust container door 164.

The air having foreign substances filtered out in the dust collecting device 160 may pass through the air outlet by the suction force of the first suction device 140 and then move to the cleaner discharge portion 14.

The robot cleaner 10 according to embodiments may include a display 170 according to an embodiment. The display 170 may display an operating status of the robot cleaner 10. The display 170 may be provided as a touch screen to receive a user's command. The display 170 may be positioned at an end portion that is opposite to a direction in which the robot cleaner 10 is docked to the docking station 20. For example, referring to FIGS. 1 and 2, as the robot cleaner 10 reverses and docks to the docking station 20, the display 170 located on the front end portion of the robot cleaner 10 may be exposed to the user even after the robot cleaner 10 is docked to the docking station 20.

Referring to FIG. 5, the docking station 20 may include a station housing 21 in which an accommodation space is formed, and a cleaner seating portion 23 in which the robot cleaner 10 is mounted.

At least a portion of a gathering device 290 for gathering foreign substances collected in the dust container 161 of the robot cleaner 10 may be disposed inside the station housing 21. In addition, electrical components for charging the battery 17 of the robot cleaner 10 may be disposed inside the station housing 21.

The station housing 21 may be provided with a station outlet. The station outlet may be provided to discharge air, which is suctioned from the dust container 161 of the robot cleaner 10 by a second suction device 250 of the docking station 20, to the outside of the docking station 20. The station outlet may be disposed on the rear surface of the station housing 21.

The station housing 21 may be provided with a discharge filter 28 that is arranged to filter air discharged through the station outlet. The discharge filter 28 may be arranged to filter air discharged from the second suction device 250. The discharge filter 28 may be disposed adjacent to the station outlet. The discharge filter 28 may include a high efficiency particulate air (HEPA) filter.

A station power board 27 may be provided in the station housing 21. The station power board 27 may be configured to receive power supplied from the outside and convert the received power to be suitable for the docking station 20. The station power board 27 may be located on the lower rear side of the station housing 21.

A station controller 29 may be provided in the station housing 21. The station controller 29 may be electrically connected to the power board 27 of the docking station 20. The station controller 29 may control the lever device 260. The station controller 29 may control the lever device 260 to be driven when the robot cleaner 10 is seated on the docking station 20. The station controller 29 may control the second suction device 250. The station controller 29 may control a station charging terminal 26.

The gathering device 290 may be provided to, upon the guide member 293 communicating with the dust container 161 of the robot cleaner 10 as the lever device 260 opens the dust container door 164, gather foreign substances collected in the dust container 161. The gathering device 290 may include the second suction device 250, a trapping portion 292, a guide member 293, and an extension member 294.

The second suction device 250 may generate a suction force for suctioning foreign substances of the dust container 161 in response to the robot cleaner 10 being seated on the docking station 20, that is, in response to the dust container 161 communicating with the guide member 293. The second suction device 250 may suction foreign substances and/or air from the dust container 161 of the robot cleaner 10, collect the foreign substances in the trapping portion 292, and discharge the air to the outside of the docking station 20 through the station outlet.

The second suction device 250 according to embodiments may, upon the robot cleaner 10 being coupled to the docking station 20 and a discharge process being performed to discharge foreign substances collected in the dust container 161 to the docking station 20, operate while periodically changing the suction force. With such a configuration, the internal pressure of the dust container 161 fluctuates, so that foreign substances in the dust container 161 may be discharged more efficiently. In this case, periodically changing the suction force of the second suction device 250 may include periodically turning on or off the second suction device 250 or periodically changing the rotational speed of the second suction device 250. In other words, the robot cleaner 10 periodically repeats an operation of supplying power to the second suction device 250 and cutting off power to the second suction device 250 such that the second suction device 250 is periodically turned on and off, or periodically repeats an operation of supplying high power to the second suction device 250 for a certain period of time and then supplying low power to the second suction device 250 for a certain period of time such that the rotational speed of the second suction device 250 is periodically changed, thereby allowing the suction force of the second suction device 250 to be periodically changed.

Specifically, the cleaning apparatus 1 may periodically change the suction force of at least one of the first suction device 140 of the robot cleaner 10 or the suction device of the docking station 20 while the discharge process is being performed to cause a change in the intake airflow, to change the flow rate inside the dust container 161, thereby varying the flow of air inside the dust container 161. As the internal pressure of the dust container 161 fluctuates, foreign substances in the dust container 161 may be discharged more efficiently.

In addition, the second suction device 250 according to embodiments may be provided to, before the suction force of at least one of the first suction device 140 of the robot cleaner 10 or the suction device of the docking station 20 is periodically changed, operate for a preset period of time to suction foreign substances and/or air from the dust container 161. That is, the second suction device 250 may be continuously powered on for a preset period of time after the start of the discharge process. With such a configuration, the cleaning apparatus 1 may allow foreign substances to be discharged from the dust container 161 to the docking station 20 first, and then in order to more efficiently discharge foreign substances remaining in the dust container 161, periodically change the suction force of at least one of the first suction device 140 of the robot cleaner 10 or the second suction device 250 of the docking station 20. The operation of the second suction device 250 during the discharge process will be described in detail below.

The trapping portion 292 may filter out foreign substances from foreign substances/or air introduced into the docking station 20 by the second suction device 250, and collect the filtered foreign substances. The trapping portion 292 may be provided with a device (not shown) for filtering out foreign substances from foreign substances and/or air guided by the guide member 293 and the extension member 294.

The guide member 293 and the extension member 294 may be provided to guide foreign substances, which are introduced into the connection opening 24, to the trapping portion 292.

The guide member 293 may extend substantially horizontally to the cleaner seating portion 23. The guide member 293 may have one end connected to the connection opening 24 and the other end connected to one end of the extension member 294. A lever of the lever device 260 may be positioned on the one end of the guide member 293 connected to the connection opening 24.

The extension member 294 may extend substantially vertically from the rear side of the station housing 21. The extension member 294 may have one end connected to the guide member 293 and the other end connected to the trapping portion 292.

The cleaner seating portion 23 may be provided to seat the robot cleaner 10 thereon. The cleaner seating portion 23 may support a lower portion of the station housing 21.

The cleaner seating portion 23 may be provided with a station charging terminal 26 for charging the battery 17 of the robot cleaner 10. The station charging terminal 206 may be electrically connected to the battery 17 of the robot cleaner 10 to supply power when the robot cleaner 10 is seated on the cleaner seating portion 23. The station charging terminal 26 may charge the battery 17 of the robot cleaner 10 using a wireless charging method.

Figure 6:
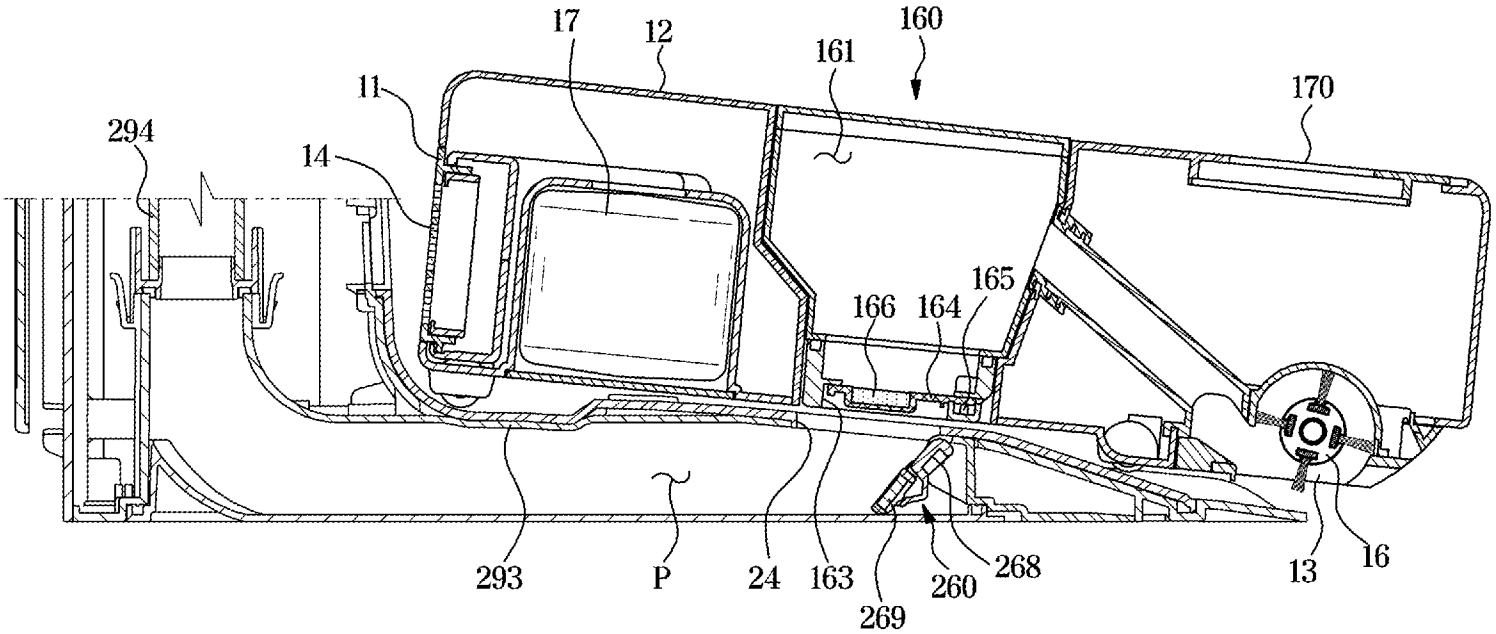
FIG. 6 is a cross-sectional view illustrating a state in which a robot cleaner is seated on a docking station according to an embodiment.
Figure 7:
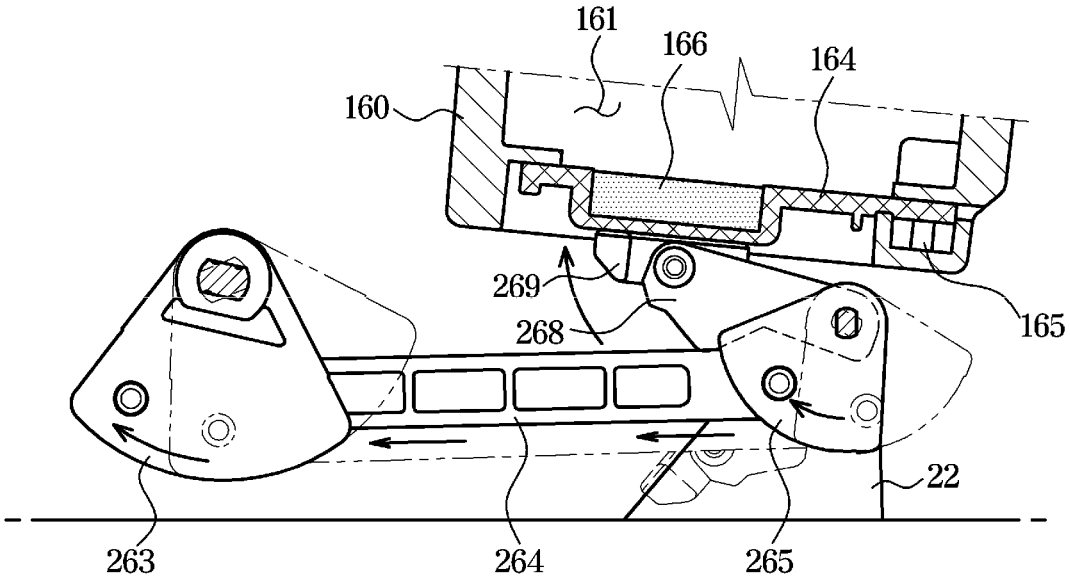
FIGS. 7 and 8 are views illustrating a state in which a dust container door of a robot cleaner is opened by a docking station according to an embodiment.
Figure 8:
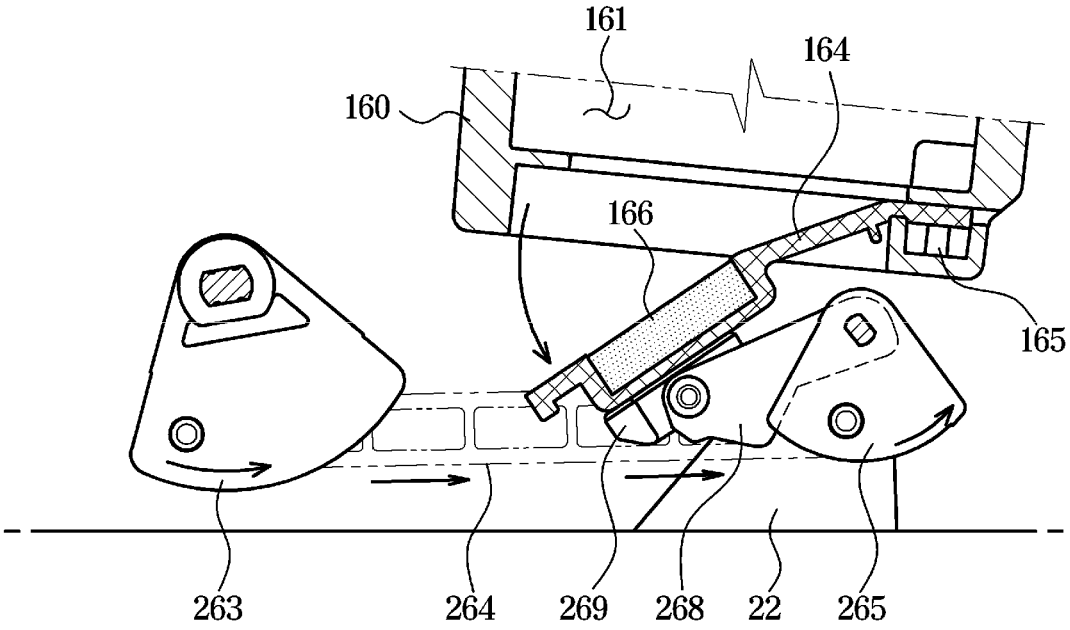
Figure 9:
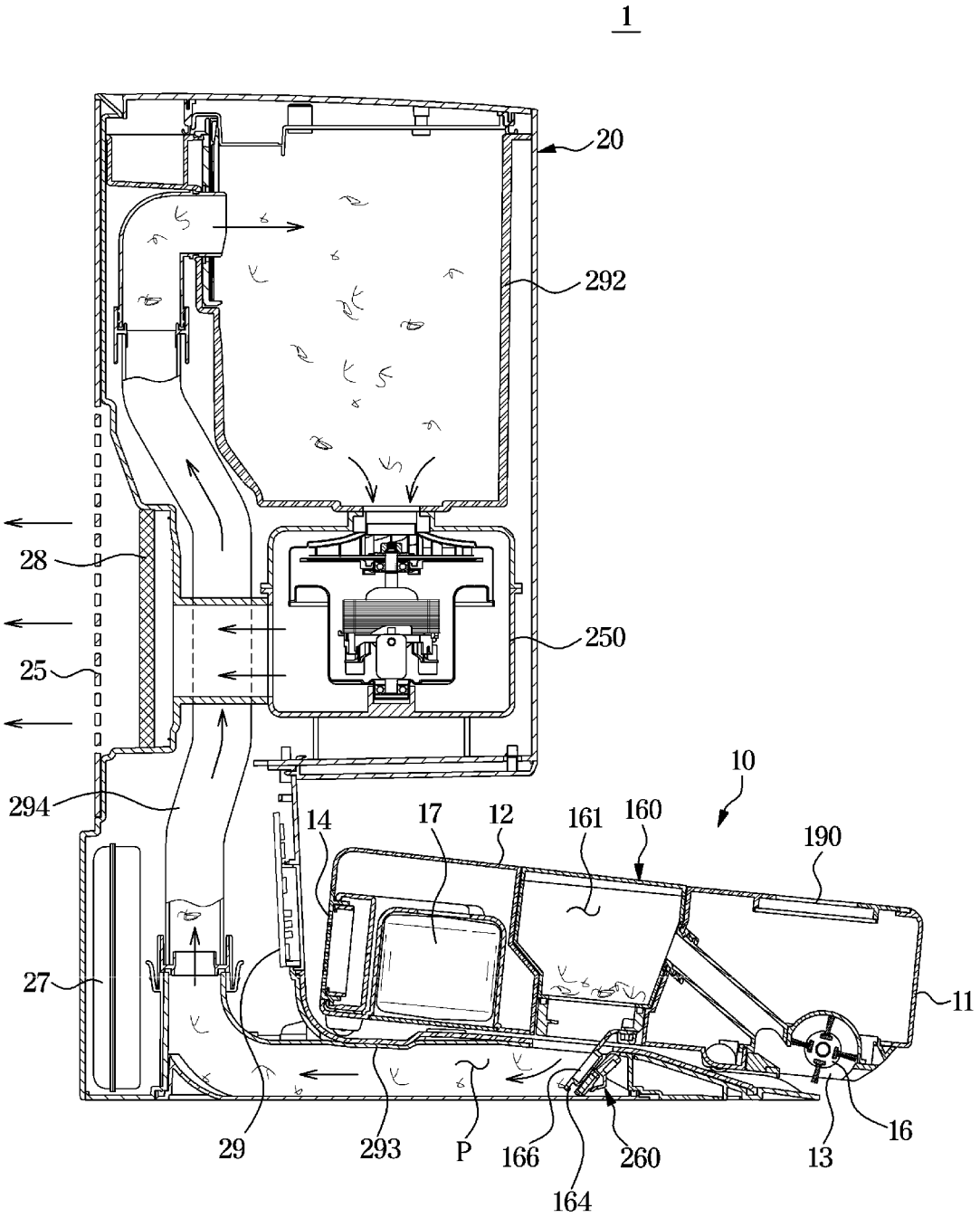
FIG. 9 is a diagram illustrating a state in which a cleaning apparatus gathers foreign substances collected from a robot cleaner according to an embodiment.

FIG. 6 is a cross-sectional view illustrating a state in which a robot cleaner 10 is seated on a docking station according to an embodiment, FIGS. 7 and 8 are views illustrating a state in which a dust container door 164 of a robot cleaner 10 is opened by a docking station 20 according to an embodiment, and FIG. 9 is a diagram illustrating a state in which a cleaning apparatus 1 gathers foreign substances collected from a robot cleaner 10 according to an embodiment.

Referring to FIG. 6, the robot cleaner 10 moves to the cleaner seating portion 23 of the docking station 20 when the amount of foreign substances collected in the dust container 161 reaches a preset amount.

A position detection sensor of the robot cleaner 10 or a position detection sensor of the docking station 20 detects that the robot cleaner 10 is located on the cleaner seating portion 23 and transmits a result of the detection to the station controller 29. The station controller 29 controls the lever device 260 to be driven. In addition, the station controller 29 may control the station charging terminal 26 to charge the battery 17 of the robot cleaner 10.

The lever device 260 may be disposed on the cleaner seating portion 23. The lever device 260 may be provided to allow the gathering device 290 to selectively communicate with the dust collecting device 160 of the robot cleaner 10. The lever device 260 may be configured to, upon the robot cleaner 10 being seated on the cleaner seating portion 23, open the dust container door 164. As shown in FIGS. 7 and 8, the lever device 260 may include a first link 263, a connecting member 264, a second link 265, and a lever 268.

The first link 263 may rotate by receiving power from a driving source. The first link 263 may rotate in both directions as the driving source rotates in both directions.

The first link 263 may be rotatably coupled to the connecting member 264. The connecting member 264 may move forward and backward as the first link 263 rotates. The connecting member 264 may transmit power of the first link 263 to the second link 265. The connecting member 264 may have one end rotatably coupled to the first link 263 and the other end rotatably coupled to the second link 265.

The second link 265 may be rotatably coupled to the connecting member 264. The second link 265 may rotate as the connecting member 264 moves. The second link 265 may be rotated in both directions as the connecting member 264 moves in the forward and backward directions. The second link 265 may be connected to the lever 228 through a shaft, and when the second link 265 rotates, the lever 268 may also rotate together.

The lever 268 may be rotatably coupled to the guide member 293. The lever 268 may be provided to rotate as the second link 265 rotates. The lever 268 may be provided to be secured to the dust container door 164 as the driving source is driven. The lever 268 may be provided to be secured to the dust container door 164 when the lever device 260 opens the dust container door 164 such that the gathering device 290 communicates with the dust container 161.

The lever 268 may be provided to be movable between a first position (see FIG. 7) in which the lever 268 is in contact with the dust container door 164 when the dust container door 164 is closed and a second position (see FIG. 8) opening the dust container door 164.

The lever 268 may include a lever magnetic body 269 provided to enable attractive force between the lever 268 and the door magnetic body 166. The lever magnetic body 269 may include a magnet. The lever magnetic body 269 may be provided to correspond to the door magnetic body 166 of the outlet door 164.

The lever magnetic body 269 may be rotatably coupled to the lever 268. As the lever magnetic body 269 is provided to be rotatable with respect to the lever 268, the lever 268 may open and close the dust container door 164 while in close contact with the dust container door 164.

The lever 268 may be movable from the second position to a third position in a direction opposite to the first position. In response to the lever 268 moving to the third position while in contact with the dust container door 164, the dust container door 164 may be separated from the lever 268. That is, the third position is a position set for separating the dust container door 164 and the lever 268.

Specifically, a release member 22 may be provided on the seating portion 23. The release member 22 may be positioned on a gathering passage P formed between the seating portion 23 and the guide member 293. The release member 22 may restrict movement of opposite ends of the dust container door 164 when the lever 268 moves from the second position to the third position. As the release member 22 restricts the movement of the opposite ends of the dust container door 164, the dust container door 164 stops rotating, and the lever 268 is separated from the release member 22 and rotates.

As shown in FIG. 7, the station controller 29 may control to drive the lever device 260 for the lever 268 to move to the first position in which the lever 268 is in contact with the dust container door 164. That is, the station controller 29 may allow the lever 268 to move toward the dust container door 164. The lever 268 may be located in the second position when the lever device 260 is not in operation. As the lever 268 moves from the second or third position to the first position, the lever 268 approaches the dust container door 164 close enough to generate an attractive force between the lever magnetic body 269 and the door magnetic body 166. Accordingly, the lever 268 is secured to the dust container door 164.

Then, as shown in FIG. 8, the station controller 29 controls to drive the lever device 260 for the lever 268 to move from the first position to the second position for opening the dust container door 164. In this case, the dust container door 164 is secured to the lever 268, and as the lever 268 rotates from the first position to the second position, the dust container door 164 also rotates together with the lever 268 so that the foreign substance outlet 163 is opened. As described above, since components other than the lever 268 of the lever device 260 for opening the dust container door 164 are disposed outside the gathering passage P, and the lever 268 is located at a position covered by the dust container door 164, a separate structure is not located on the gathering passage P in a state in which the dust container door 164 is opened, so that foreign substances may be prevented from being entangled on the gathering passage P.

To this end, according to the disclosure, the size of the attractive force between the door magnetic body 166 and the lever magnetic body 269 may be provided to be greater than the size of an elastic force that keeps the foreign substance outlet 163 closed by the outlet door 164.

Thereafter, the station controller 29 may, upon completion of the gathering of foreign substances by the dust collecting device 160, control the lever 268 to move from the second position to the third position. Accordingly, the lever 268 may be further rotated in the direction of opening the dust container door 164. When the lever 268 rotates from the second position to the third position, the rotation of opposite ends of the dust container door 164 is restricted by the release member 22. In this case, since the dust container door 164 is formed of a material having elasticity, a central portion of the dust container door 164 in which the lever magnetic body 269 is disposed may be slightly deformed while moving along the lever 268. Thus, the lever 268 may be set to rotate enough to be separated from the outlet door 114. Accordingly, the lever 268 may be separated from the dust container door 164 and rotate to the third position.

In the cleaning apparatus 1 according to an embodiment of the disclosure, the door magnetic body 166 and the lever magnetic body 269 are provided on the dust container door 164 and the lever 268, respectively, and the lever 268 at the second position may be allowed to be further rotated in a direction that opens the dust container door 164, so that the dust container door 164 and the lever 268 may be relatively easily secured and released.

However, the structure of the dust container door 164 of the robot cleaner 10 and the lever device 260 of the docking station 20 may be implemented without limitation as long as it can open or close the dust container door 164 according to the operation of the lever device 260.

As shown in FIG. 9, as the lever device 260 opens the dust container door 164, the gathering device 290 suctions foreign substances inside the dust collecting device 160. The foreign substances of the dust collecting device 160 are moved to the trapping portion 292 along the guide member 293 and the extension member 294. Foreign substances are collected in the trapping portion 292, and foreign substances and air, passed through the second suction device 250, are filtered through the discharge filter 28 before being discharged through the station outlet 25. The air filtered by the discharge filter 28 is discharged to the outside through the station outlet 25.

As described above, when the second suction device 250 of the docking station 20 is continuously powered on and the same intake airflow is supplied to the dust container 161, some of the foreign substances may be caught with internal components of the dust container 161 and may not be discharged to the outside. For example, foreign substances, such as hair, may be caught with internal components of the dust container 161 and despite the intake airflow, remain inside the dust container 161 without being separated from the outside of the dust container 161. That is, the intake airflow delivered to the inside of the dust container 161 may be formed only in the same direction. Accordingly, some foreign substances may have a resistance to the direction in which the intake airflow is formed, and thus may not escape to the outside of the dust container 161 by the intake airflow. Therefore, foreign substances inside the dust container 161 may not be effectively discharged.

Accordingly, the cleaning apparatus 1 may periodically change the suction force of at least one of the first suction device 140 of the robot cleaner 10 or the second suction device 250 of the docking station 20 while the discharge process is being performed to cause a change in the intake airflow, to change the flow rate inside the dust container 161, thereby varying the flow of air inside the dust container 161. As the internal pressure of the dust container 161 fluctuates, foreign substances in the dust container 161 may be discharged more efficiently.

In addition, the cleaning apparatus 1 according to embodiments is provided to, after a suction force of at least one of the first suction device 140 of the robot cleaner 10 or the second suction device 250 of the docking station 20 is periodically changed, operate only the first suction device 140 for a preset period of time such that foreign substances remaining between the dust container 161 and the dust container door 164 are suctioned back into the dust container 161. With such a configuration, deterioration of sealing of the dust container 161 that may occur due to foreign substances remaining between the dust container 161 and the dust container door 164 may be prevented, thus preventing air from flowing through a region between the dust container 161 and the dust container door and finally preventing the suction force of the robot cleaner 10 from being reduced. In addition, foreign substances (e.g., hair) remaining between the dust container 161 and the dust container door may be prevented from being exposed to the outside of the robot cleaner 10, thereby preventing a user from feeling displeasure.

In the above description, the structure of the cleaning apparatus 1 and the basic operation for the discharge process have been described. Hereinafter, the cleaning apparatus 1 will be described in more detail with regard to performing the discharge process.

Figure 10:
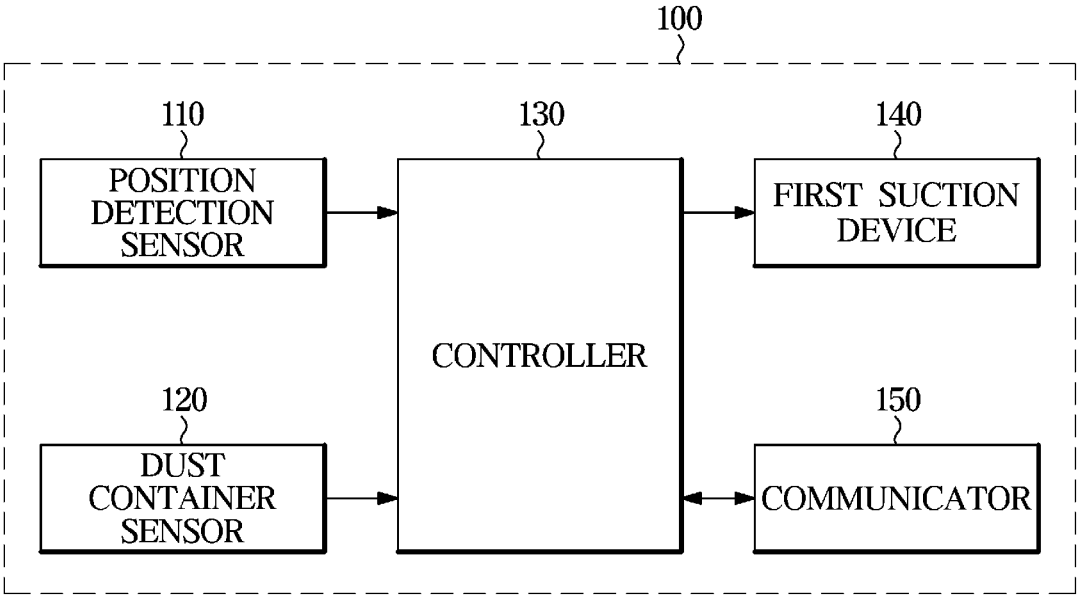
FIG. 10 is a control block diagram illustrating a robot cleaner according to an embodiment.

FIG. 10 is a control block diagram illustrating a robot cleaner 10 according to an embodiment.

Referring to FIG. 10, the robot cleaner 10 according to an embodiment includes a position detection sensor 110 for detecting the position of the robot cleaner 10, a dust container sensor 120 for detecting whether the dust container 161 is saturated, a controller 130 for controlling discharge of foreign substances from the dust container 161, a first suction device 140 for providing a suction force, and a communicator 150 for communicating with the docking station 20. Depending on embodiments, components other than those shown in FIG. 10 may be added or components shown in FIG. 10 may be omitted.

The position detection sensor 110 according to an embodiment may detect the position of the robot cleaner 10. Specifically, the position detection sensor 110 may detect whether the robot cleaner 10 is located on the seating portion 23 of the docking station 20. To this end, the position detection sensor 110 may be provided as a radar sensor, a light detection and ranging (Lidar) sensor, or an infrared sensor, and the type is not limited as long as it is a sensor for position detection.

The dust container sensor 120 according to an embodiment may detect whether the dust container 161 is saturated. To this end, the dust trapping portion sensor 120 may be provided as an infrared sensor, and the type is not limited as long as it is a sensor for saturation detection.

The controller 130 according to an embodiment may perform a discharge process such that foreign substances in the dust container 161 are discharged to the docking station 20.

The controller 130 may, upon determining that the amount of foreign substances collected in the dust container 161 has reached a preset amount based on an output of the dust container sensor 120, control the robot cleaner 10 to move the docking station 20.

The controller 130 may, upon determining that the robot cleaner 10 is coupled to the docking station 20 based on an output of the position detection sensor 110, control the communicator 150 to transmit a control command for opening the dust container door 164 to the docking station 20.

Thereafter, the controller 130 may control the first suction device 140 and control the communicator 150 to transmit a control command to the docking station 20 so that the suction force of at least one of the first suction device 140 of the robot cleaner 10 or the second suction device 250 of the docking station 20 is periodically changed.

That is, the controller 130 periodically changes the suction force of at least one of the first suction device 140 of the robot cleaner 10 or the second suction device 250 of the docking station 20 to supply the dust container 161 with an irregular intake airflow such that the foreign substances in the dust container 161 may be discharged more efficiently.

For example, the controller 130 according to embodiments may periodically change the suction force of each of the first suction device 140 and the second suction device 250 such that the first suction device 140 and the second suction device 250 operate alternately with each other for a preset period of time.

In addition, the controller 130 according to embodiments may periodically change the suction force of the second suction device 250 in a state in which the first suction device 140 is stopped.

In addition, the controller 130 according to embodiments may periodically change the suction force of the second suction device 250 in a state in which the first suction device 140 is continuously powered on.

In addition, the controller 130 according to embodiments may periodically change the suction force of the first suction device 140 in a state in which the second suction device 250 is continuously powered on.

In addition, the controller 130 according to embodiments may, upon the robot cleaner 10 being coupled to the docking station 20, control the communicator 150 to transmit a control command for the second suction device 250 to operate for a preset period of time before the suction force of at least one of the first suction device 140 or the second suction device 250 periodically changes to the docking station 20.

In addition, the controller 130 according to embodiments may be configured to control the first suction device 150 to operate only the first suction device 140 for a preset period of time while the second suction device 250 is not in operation after a suction force of the first suction device 140 or the second suction device 250 is periodically changed.

The controller 130 may, upon the discharge process being completed, control the communicator 150 to transmit a control command for closing the dust container door 164 to the docking station 20.

Execution of the discharge process by the controller 130 will be described in detail below.

The controller 130 may include at least one memory for storing a program for performing the above-described operation and an operation to be described below, and at least one processor for executing the stored program.

The first suction device 140 may operate while periodically changing the suction force during the discharge process under the control of the controller 130.

In addition, the first suction device 140 according to embodiments may operate for a preset period of time after a suction force of at least one of the first suction device 140 of the robot cleaner 10 or the suction device of the docking station 20 is periodically changed for changing of the intake airflow. That is, the first suction device 140 may be continuously powered on for a preset period of time before the end of the discharge process. The operation of the first suction device 140 during the discharge process will be described in detail below.

The communicator 150 according to an embodiment may transmit and receive information to and from the docking station 20. To this end, the communicator 150 may be provided as a communication module for a known type of communication protocol.

Figure 11:
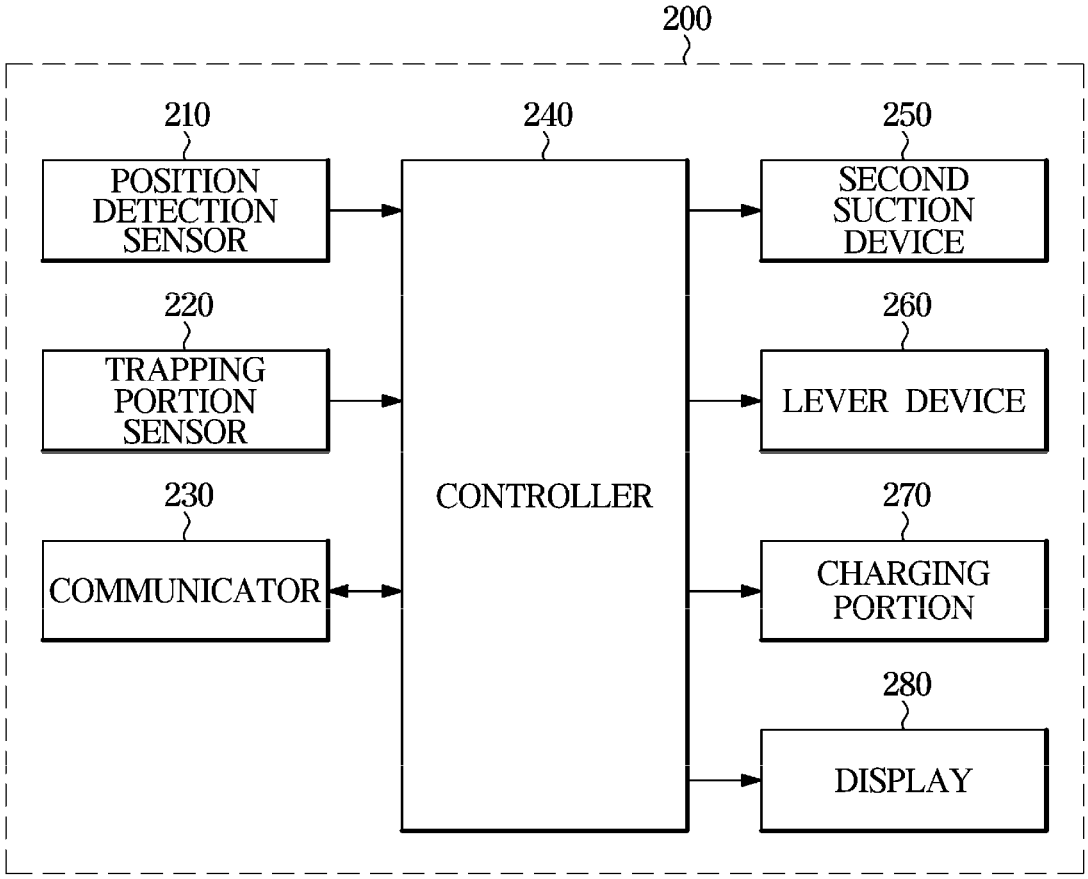
FIG. 11 is a control block diagram illustrating a docking station according to an embodiment.

FIG. 11 is a control block diagram illustrating a docking station according to an embodiment.

Referring to FIG. 11, the docking station 20 according to an embodiment includes a position detection sensor 210 for detecting whether the robot cleaner 10 is located on the seating portion 23, a trapping portion sensor 220 for detecting whether the trapping portion 292 is saturated, a communicator 230 for communicating with the robot cleaner 10, a controller 240 for performing a discharge process, a second suction device 250 for providing the dust container 161 with a suction force, a lever device 260 for opening and closing the dust container door 164, a charging portion 270 for charging the battery 17 of the robot cleaner 10, and a display 280 for displaying various types of information, such as saturation of the trapping portion 292. Depending on embodiments, components other than those shown in FIG. 11 may be added or components shown in FIG. 11 may be omitted.

The position detection sensor 210 according to an embodiment may detect whether the robot cleaner 10 is located on the seating portion 23. To this end, the position detection sensor 210 may be provided as an infrared sensor, and the type is not limited as long as it is a sensor capable of detecting the position of the robot cleaner 10.

The trapping portion sensor 220 according to an embodiment may detect whether the trapping portion 292 is saturated. To this end, the trapping portion sensor 220 may be provided as an infrared sensor, and the type is not limited as long as it is a sensor capable of detecting whether the trapping portion 292 is saturated.

The communicator 230 according to an embodiment may transmit and receive information to and from the robot cleaner 10. To this end, the communicator 230 may be provided as a communication module for a known type of communication protocol.

The controller 240 according to an embodiment may, upon the robot cleaner 10 being coupled to the docking station 20, perform a discharge process. In this case, the controller 240 may correspond to the station controller 29.

The controller 240 may, in response that the robot cleaner 10 is coupled to the docking station 20 and a control command for opening the dust container door 164 is received through the communicator 230, control the lever device 260 to open the dust container door 164.

The controller 240 may, in response that the dust container door 164 is opened and a control command for operating the second suction device 250 is received through the communicator 230, control the second suction device 250 to operate. Specifically, the controller 240 may control the second suction device 250 to operate while periodically changing the suction force for a preset period of time or to continuously operate for a preset period of time.

In addition, the controller 240 according to embodiments may, upon a control command for operating the second suction device 250 being received through the communicator 230, control the second suction device 250 to operate for a preset period of time before at least one of the suction force of the first suction device 140 or the second suction device 250 is periodically changed. That is, the controller 240 may control the second suction device 250 to be continuously powered on for a preset period of time after the start of the discharge process.

The controller 240 may, upon a control command for closing the dust container door 164 being received through the communicator 230, control the lever device 260 to close the dust container door 164.

Execution of the discharge process by the controller 240 will be described in detail below.

The controller 240 according to an embodiment may, upon the robot cleaner 10 being coupled to the docking station 20, control the charging portion 270 to charge the battery 17 of the robot cleaner 10. For example, the controller 240 may, in response that the robot cleaner 10 is coupled to the docking station 20 and the first suction device 140 of the robot cleaner 10 is not in operation, control the charging portion 270 to charge the battery 17 of the robot cleaner 10.

The controller 240 according to embodiments may, upon a control command for charging being received from the robot cleaner 10, control the charging portion 270 to charge the battery 17 of the robot cleaner 10.

The controller 240 according to an embodiment may, upon determining that the trapping portion 292 is saturated based on the output of the trapping portion sensor 220, control the display 280 to display the saturation of the trapping portion 292.

The controller 240 may include at least one memory for storing a program for performing the above-described operation and an operation to be described below, and at least one processor for executing the stored program.

The second suction device 250 according to an embodiment may supply the dust container 161 with a suction force for a discharge process under the control of the controller 240.

Specifically, the second suction device 250 may operate while periodically changing the suction force during the discharge process under the control of the controller 240.

In addition, the second suction device 250 according to embodiments may, before the suction force of at least one of the first suction device 140 or the second suction device 250 is periodically changed, operate for a preset period of time under the control of the controller 240. The operation of the second suction device 250 during the discharge process will be described in detail below.

The lever device 260 according to an embodiment may, in response to an initiation of a discharge process under the control of the controller 240, open the dust container door 164. In addition, the lever device 260 according to an embodiment may, in response to an end of the discharge process under the control of the controller 240, close the dust container door 164.

The charging portion 270 according to an embodiment may charge the battery 17 of the robot cleaner 10 under the control of the controller 240. To this end, the charging portion 270 may include a station charging terminal 26 provided on the cleaner seating portion 23.

The display 280 according to an embodiment may display a saturation state of the trapping portion 292 according to control of the controller 240. The display 280 may be provided as a previously known type of display and may be provided on the station housing 21. For example, the display 280 may be provided as a light emitting diode (LED), and may output first light (e.g., blue light) when the trapping portion 292 is unsaturated, and output second light (e.g., red light) when the trapping portion 292 is saturated.

In the above description, each configuration of the robot cleaner 10 and the docking station 20 has been described. Hereinafter, the robot cleaner 10 and the docking station 20 are described in more detail with regard to performing the discharge process.

Figure 12:
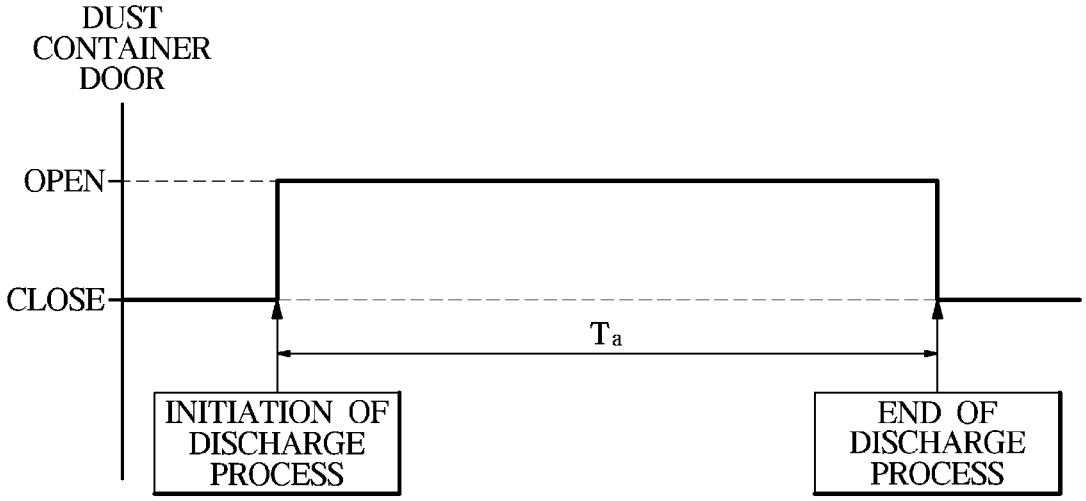
FIG. 12 is a view for describing a case of determining whether to open a dust container door in a discharge process by a cleaning apparatus according to an embodiment.

FIG. 12 is a view for describing a case of determining whether to open a dust container door 164 in a discharge process by a cleaning apparatus 1 according to an embodiment.

Referring to FIG. 12, the cleaning apparatus 1 according to an embodiment may, upon the robot cleaner 10 being coupled to the docking station 20, perform a discharge process. In this case, the cleaning apparatus 1 may, in response to an initiation of the discharge process, control the lever device 260 of the docking station 20 to open the dust container door 164 of the robot cleaner 10.

In addition, the cleaning apparatus 1 according to an embodiment may, in response to an end of the discharged process after the discharge process has been performed for a preset period of time $T_a$, control the lever device 260 of the docking station 20 to close the dust container door 164.

The robot cleaner 10 may, upon determining that the amount of foreign substances collected in the dust container 161 has reached a preset amount based on an output of the dust trapping portion sensor 120, control the robot cleaner 10 to move to the docking station 20.

The robot cleaner 10 may determine that the robot cleaner 10 is coupled to the docking station 20, based on the output of at least one of the position detection sensor 110 of the robot cleaner 10, the position detection sensor 210 of the docking station 20, or the charging terminal 26 of the docking station 20, The robot cleaner 10 may, upon the robot cleaner 10 being coupled to the docking station 20, initiate the discharge process. In this case, the robot cleaner 10 may transmit a control command for opening the dust container door 164 to the docking station 20, and the docking station 20 may open the dust container door 164.

In addition, the robot cleaner 10 may, based the preset period of time $T_a$ elapsing from the initiation of the discharge process, end the discharge process. In this case, the robot cleaner 10 may transmit a control command for closing the dust container door 164 to the docking station 20, and the docking station 20 may close the dust container door 164.

Figure 13:
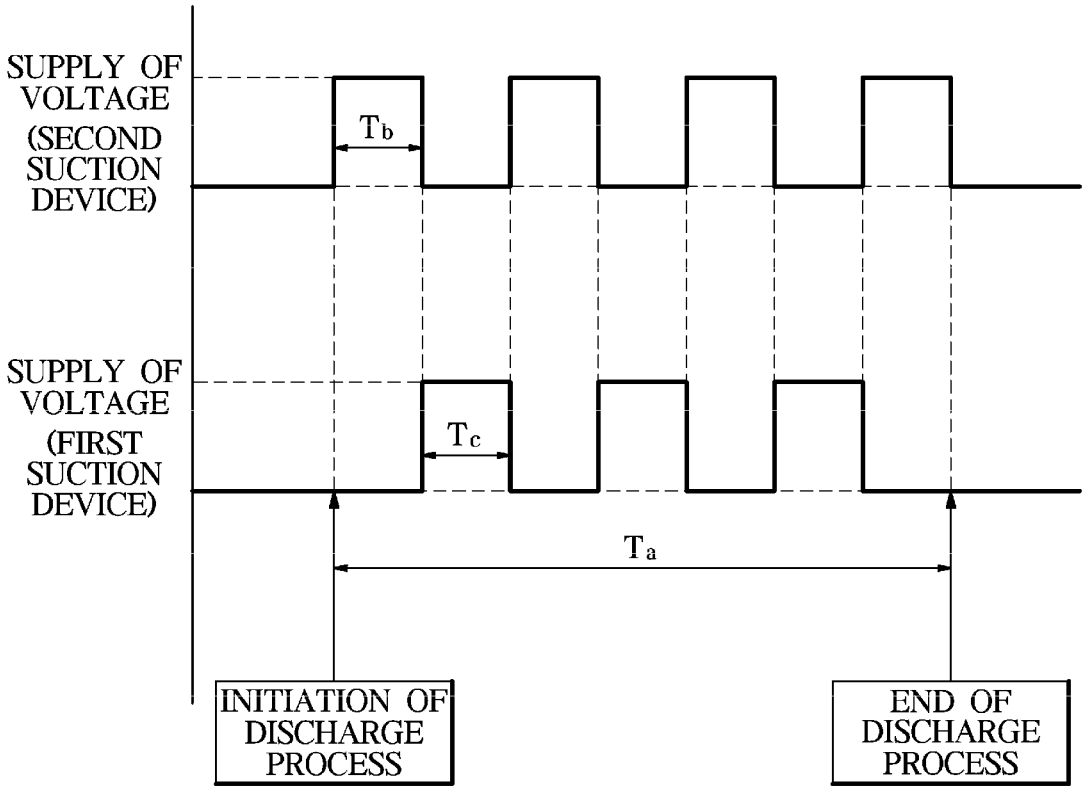
FIGS. 13 and 16 are views for describing a case of changing the suction force of at least one of a suction device of a robot cleaner or a suction device of a docking station when a cleaning apparatus performs a discharge process according to an embodiment.
Figure 16:
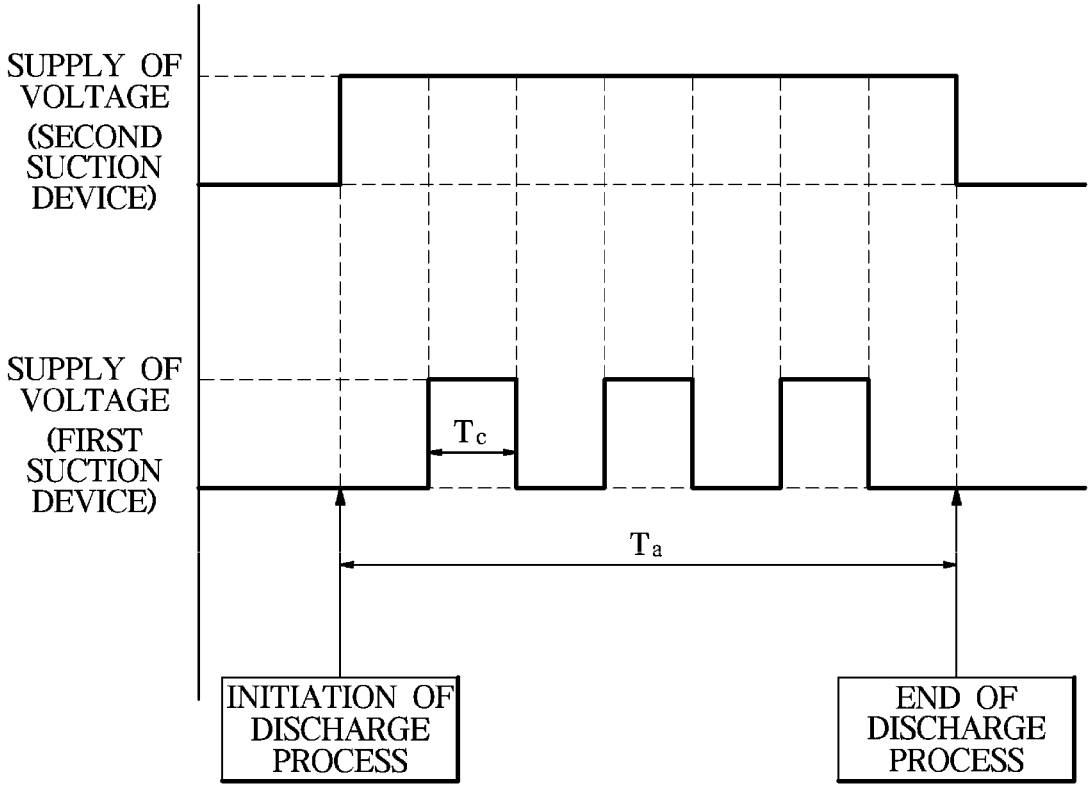
Figure 17:
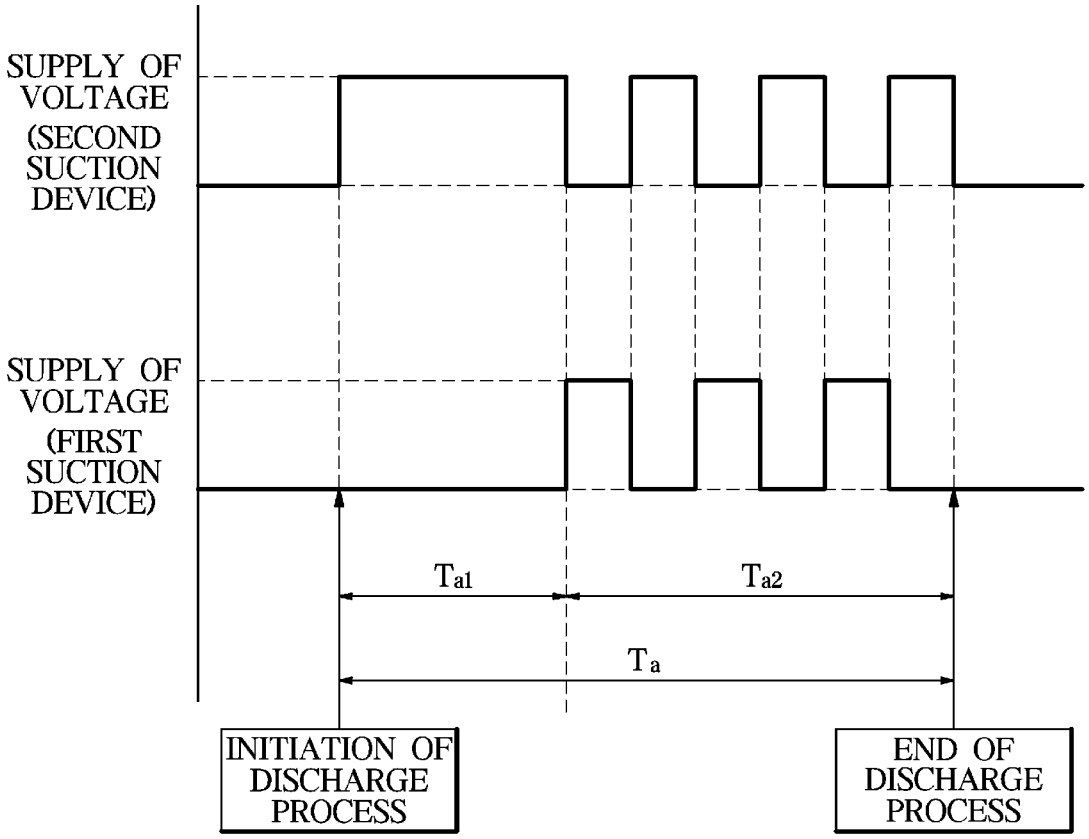
FIG. 17 is a view for describing a case of preferentially operating a suction device of a docking station when a cleaning apparatus performs a discharge process according to an embodiment.
Figure 18:
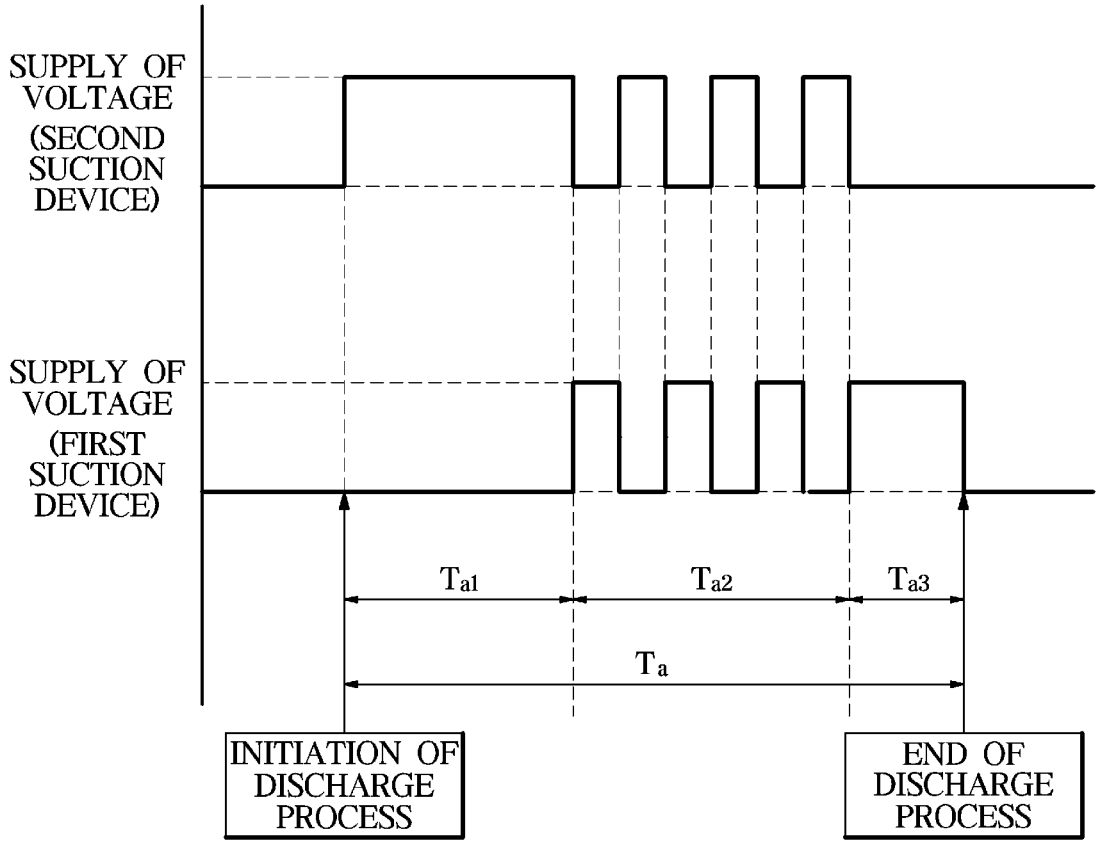
FIG. 18 is a view for describing a case of additionally operating a suction device of a robot cleaner when a cleaning apparatus performs a discharge process according to an embodiment.
Figure 19:
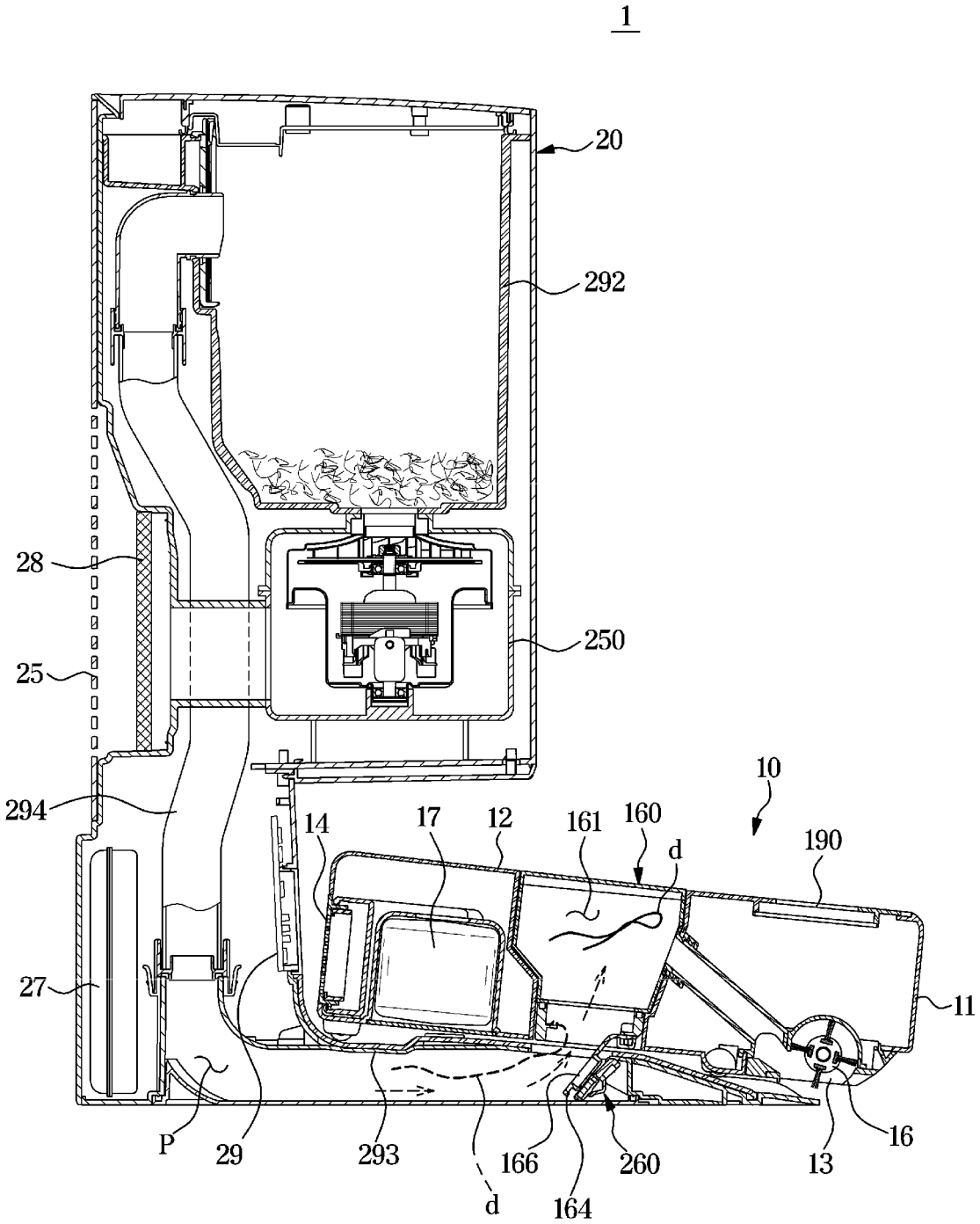
FIG. 19 is a view illustrating a state in which a cleaning apparatus according to an embodiment additionally operates a suction device of a robot cleaner.

FIGS. 13 and 16 are views for describing a case of changing the suction force of at least one of a suction device 140 of a robot cleaner 10 or a suction device 250 of a docking station 20 when a cleaning apparatus 1 performs a discharge process according to an embodiment, FIG. 17 is a view for describing a case of preferentially operating a suction device 250 of a docking station 20 when a cleaning apparatus 1 performs a discharge process according to an embodiment, FIG. 18 is a view for describing a case of additionally operating a suction device 10 of a robot cleaner 10 when a cleaning apparatus 1 performs a discharge process according to an embodiment, and FIG. 19 is a view illustrating a state in which a cleaning apparatus 1 according to an embodiment additionally operates a suction device 140 of a robot cleaner 10.

When the second suction device 250 of the docking station 20 is continuously powered on and the same intake airflow is supplied to the dust container 161, some of the foreign substances may be caught with internal components of the dust container 161 and may not be discharged to the outside. For example, foreign substances, such as hair, may be caught with internal components of the dust container 161 and despite the intake airflow, remain inside the dust container 161 without being separated from the outside of the dust container 161. That is, the intake airflow delivered to the inside of the dust container 161 may be formed only in the same direction. Accordingly, some foreign substances may have a resistance to the direction in which the intake airflow is formed, and thus may not escape to the outside of the dust container 161 by the intake airflow. Therefore, foreign substances inside the dust container 161 may not be effectively discharged.

Referring to FIGS. 13 and 16, the cleaning apparatus 1 may periodically change the suction force of at least one of the first suction device 140 of the robot cleaner 10 or the second suction device 250 of the docking station 20 while the discharge process is being performed to cause a change in the intake airflow, to change the flow rate inside the dust container 161, thereby varying the flow of air inside the dust container 161. As the internal pressure of the dust container 161 fluctuates, foreign substances in the dust container 161 may be discharged more efficiently.

That is, the robot cleaner 10 may control the first suction device 140 and control the communicator 150 to transmit a control command to the docking station 20, so that the suction force of at least one of the first suction device 140 of the robot cleaner 10 or the second suction device 250 of the docking station 20 is periodically changed. In this case, the controller 130 may periodically change the suction force of at least one of the first suction device 140 of the robot cleaner 10 or the second suction device 250 of the docking station 20 for a preset period of time $T_a$.

In this case, periodically changing the suction force of the first suction device 140 may include periodically turning on or off the first suction device 140 or periodically changing the rotational speed of the first suction device 140. In other words, the robot cleaner 10 periodically repeats an operation of supplying power to the first suction device 140 and cutting off power to the first suction device 140 such that the first suction device 140 is periodically turned on and off, or periodically repeats an operation of supplying high power to the first suction device 140 for a certain period of time and then supplying low power to the first suction device 140 for a certain period of time such that the rotational speed of the first suction device 140 is periodically changed, thereby allowing the suction force of the first suction device 140 to be periodically changed.

In this case, periodically changing the suction force of the second suction device 250 may include periodically turning on or off the second suction device 250 or periodically changing the rotational speed of the second suction device 250. In other words, the robot cleaner 10 periodically repeats an operation of supplying power to the second suction device 250 and cutting off power to the second suction device 250 such that the second suction device 250 is periodically turned on and off, or periodically repeats an operation of supplying high power to the second suction device 250 for a certain period of time and then supplying low power to the second suction device 250 for a certain period of time such that the rotational speed of the second suction device 250 is periodically changed, thereby allowing the suction force of the second suction device 250 to be periodically changed.

As shown in FIG. 13, the cleaning apparatus 1 according to an embodiment may, in response to an initiation of a discharge process, periodically change the suction force of each of the first suction device 140 of the robot cleaner 10 or the second suction device 250 of the docking station 20 such that the first suction device 140 and the second suction device 250 operate alternately with each other for a preset period of time.

Voltage may be alternately supplied to the first suction device 140 and the second suction device 250. For example, during a time Tb in which the voltage is supplied to the second suction device 250, the voltage is not supplied to the first suction device 140, and during a time $T_c$ in which the voltage is supplied to the first suction device 140, the voltage is not supplied to the second suction device 250. As another example, during a time Tb in which a high voltage is supplied to the second suction device 250, a low voltage is supplied to the first suction device 140, and during a time $T_c$ in which a high voltage is supplied to the first suction device 140, a low voltage may be supplied to the second suction device 250.

Figure 14:
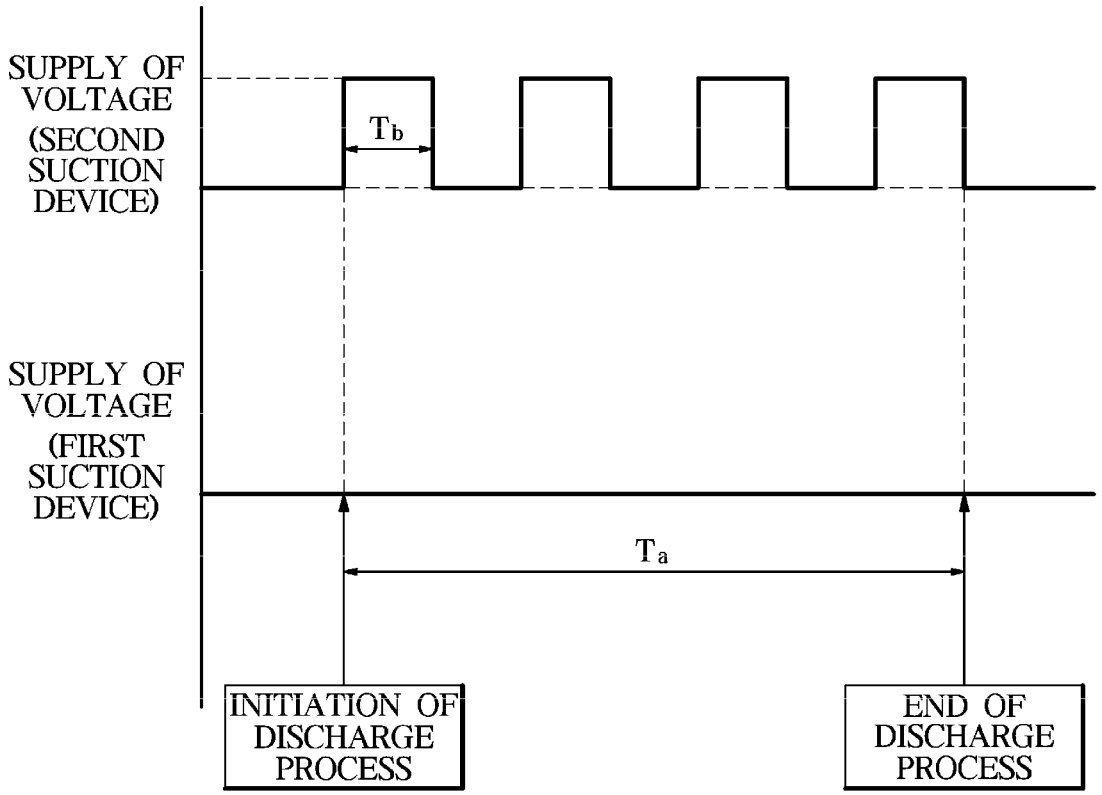

As shown in FIG. 14, the cleaning apparatus 1 according to an embodiment may, in response to an initiation of a discharge process, periodically change the suction force of the second suction device 250 in a state in which the first suction device 140 is stopped.

Specifically, the robot cleaner 10 may transmit, to the docking station 20, a control command for the second suction device 250 to periodically change the suction force, and the docking station 20 may periodically change the suction force of the second suction device.

Figure 15:
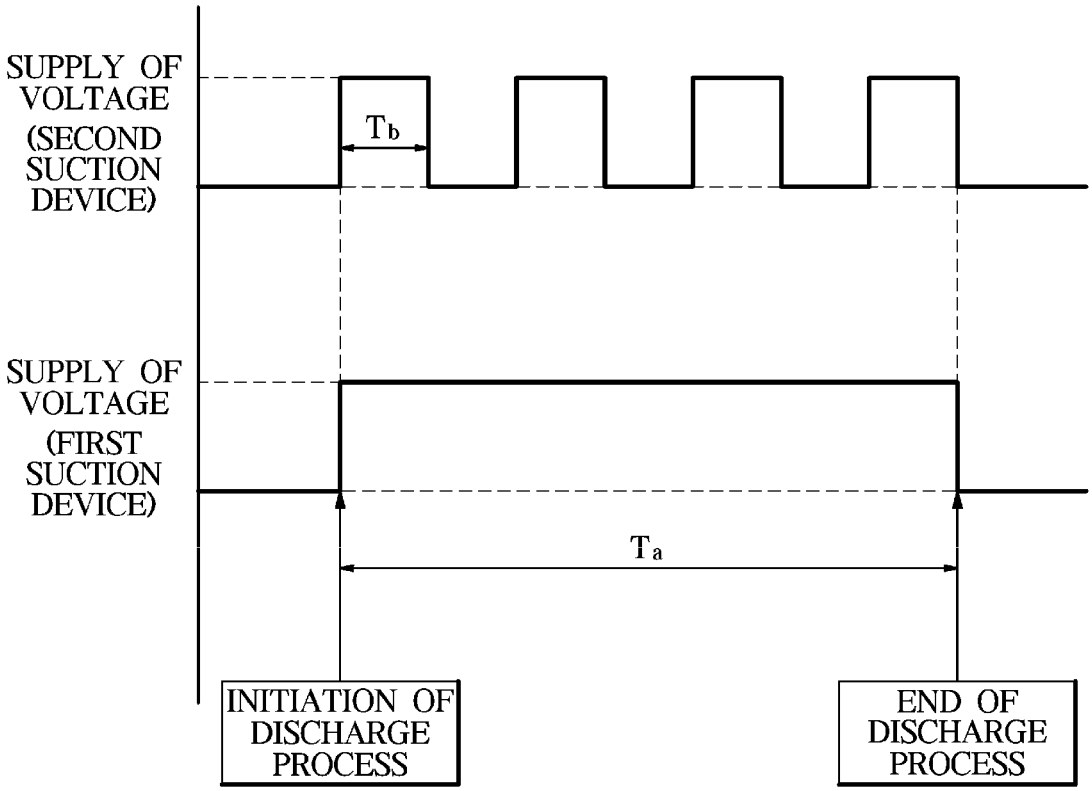

As shown in FIG. 15, the cleaning apparatus 1 according to an embodiment may, in response to an initiation of a discharge process, periodically change the suction force of the second suction device 250 in a state in which the first suction device 140 is continuously powered on.

Specifically, the robot cleaner 10 may continuously supply power to the first suction device 140 while transmitting, to the docking station 20, a control command for the second suction device 250 to periodically change the suction force. Accordingly, the docking station 20 may periodically change the suction force of the second suction device 250.

As shown in FIG. 16, the cleaning apparatus 1 according to an embodiment may, in response to an initiation of a discharge process, periodically change the suction force of the first suction device 140 in a state in which the second suction device 250 is continuously powered on.

Specifically, the robot cleaner 10 may periodically change the power supplied to the first suction device 140 while transmitting, to the docking station 20, a control command for the second suction device 250 to continuously operate. Accordingly, the docking station 20 may continuously supply power to the second suction device 250.

As described above, the cleaning apparatus 1 may, during the discharge process, periodically change the suction force of at least one of the first suction device 140 of the robot cleaner 10 or the second suction device 250 of the docking station 20 for a preset period of time, to supply the dust container 161 with an irregular intake airflow, thereby varying the flow of air inside the dust container 161. Accordingly, the fluctuation in internal pressure of the dust container 161 may allow the foreign substances in the dust container 161 to be more efficiently discharged.

In addition, the cleaning apparatus 1 according to embodiments may, in response to an initiation of a discharge process, allow the second suction device 250 to preferentially operate for a preset period of time $T_{a1}$ before the suction force of at least one of the first suction device 140 of the robot cleaner 10 or the second suction device 250 of the docking station 20 is periodically changed.

In this case, as shown in FIG. 17, the voltage may be supplied only to the second suction device 250 during a first period of time $T_{a1}$ of the operation time $T_a$ of the discharge process, and during a second period of time $T_{a2}$ subsequent to the first period of time $T_{a1}$, the suction force of at least one of the first suction device 140 or the second suction device 250 may be periodically changed.

To this end, the robot cleaner 10 according to embodiments may, upon the robot cleaner 10 being coupled to the docking station 20, control the communicator 150 to transmit, to the docking station 20*a*, a control command for operating the second suction device 250 for the preset period of time $T_{a1}$ before the suction force of at least one of the first suction device 140 or the second suction device 250 is periodically changed. The second suction device 250 according to embodiments may, before the suction force of at least one of the first suction device 140 or the second suction device 250 is periodically changed, operate for the preset period of time $T_{a1}$, to suction foreign substances and/or air from the dust container 161.

With such a configuration, the cleaning apparatus 1 may allow foreign substances to be preferentially discharged from the dust container 161 to the docking station 20, and then in order for foreign substances remaining in the dust container 161 to be more efficiently discharged, periodically change the suction force of at least one of the first suction device 140 of the cleaner 10 or the second suction device 250 of the docking station 20.

In addition, the cleaning apparatus 1 according to embodiments may, control the first suction device 140 such that only the first suction device 140 operates for a preset period of time $T_{a3}$ after the suction force of at least one of the first suction device 140 or the second suction device 250 is periodically changed.

In this case, as shown in FIG. 18, the voltage may be supplied only to the second suction device 250 during a first period of time $T_{a1}$ of the operation time $T_a$ of the discharge process, and during a second period of time $T_{a2}$ subsequent to the first period of time $T_{a1}$, the suction force of at least one of the first suction device 140 or the second suction device 250 may be periodically changed, and during a third time $T_{a3}$ subsequent to the second period of time $T_{a2}$, the voltage may be supplied only to the first suction device 140.

That is, the robot cleaner 10 according to embodiments may control the first suction device 140 such that only the first suction device 140 operates for a preset period of time $T_{a3}$ while the second suction device 250 is not in operation, after periodically changing the suction force of at least one of the first suction device 140 or the second suction device 250 to irregularly supply an intake airflow.

As shown in FIG. 19, when foreign substances are discharged from the dust container 161 according to an operation of the second suction device 250, foreign substances d may present between the dust container 161 and the dust container door 164.

Without an operation of the first suction device 140 after the operation of the second suction device 250, the dust container door 164 may be closed in a state in which foresing substances d are present between the dust container 161 and the dust container door 164, and thus the dust container 161 may not be properly sealed by the dust container door 164. That is, a separation may occur between the dust container 161 and the dust container door 164 due to the foreign substances d, and air may flow through the separation during a cleaning process, resulting in a decrease in suction force of the robot cleaner 10.

In addition, as the dust container door 164 is closed in a state in which foreign substances d are present between the dust container 161 and the dust container door 164, the foreign substances d may be exposed to the outside of the robot cleaner 10.

Therefore, the first suction device 140 according to embodiments may alternately operate with the suction device of the docking station 20 and then operate for a preset period of time such that foreign substances remaining between the dust container 161 and the dust container door for opening and closing the dust container 161 are collected back to the dust container 161. Accordingly, the foreign substances d positioned between the dust container 161 and the dust container door 164 may move into the dust container 161.

With such a configuration, deterioration of sealing of the dust container 161 that may occur due to foreign substances remaining between the dust container 161 and the dust container door 164 may be prevented, thus preventing air from flowing through a region between the dust container 161 and the dust container door 164 and finally preventing the suction force of the robot cleaner 10 from being reduced. In addition, foreign substances (e.g., hair) remaining between the dust container 161 and the dust container door 164 may be prevented from being exposed to the outside of the robot cleaner 10, thereby preventing a user from feeling displeasure.

FIGS. 17 and 18 are embodiments in which the suction force of at least one of the first suction device 140 or the second suction device 250 is periodically changed, showing embodiments that the first suction device 140 and the second suction device 250 operates alternately, but this is only an example, and may be applied to an embodiment in which the suction force of the second suction device 250 is periodically changed while the first suction device 140 is in in an off state, an embodiment in which the suction force of the second suction device 250 is periodically changed while the first suction device 140 is in an on state, and an embodiment in which the suction force of the first suction device 140 is periodically changed while the second suction device 140 is in an on state.

Hereinafter, an embodiment of a method of controlling a cleaning apparatus 1 according to an aspect will be described. The cleaning apparatus 1 according to the above-described embodiment may be used in the method of controlling the cleaning apparatus 1. Therefore, the contents described above with reference to FIGS. 1 to 19 may be equally applied to the method of controlling the cleaning apparatus 1.

Figure 20:
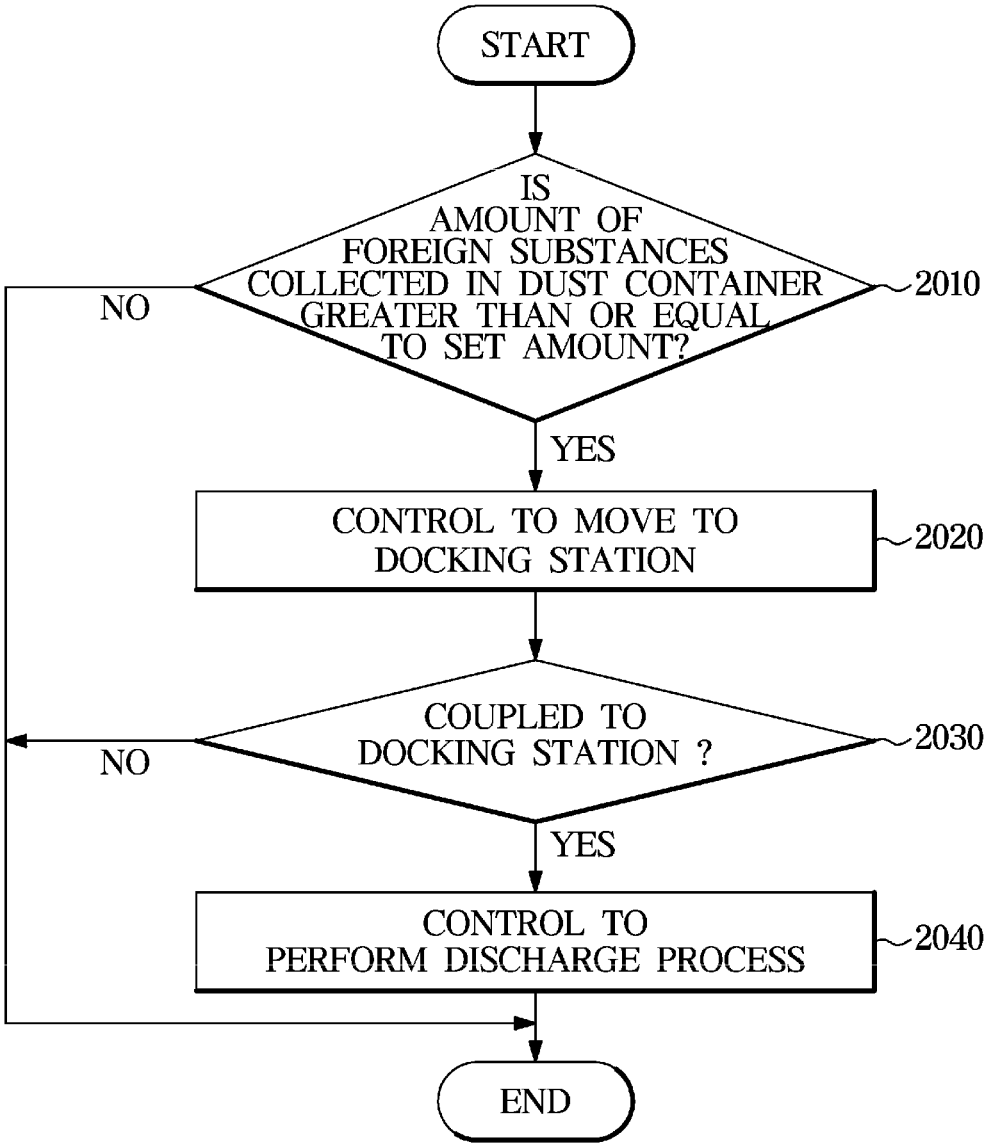
FIG. 20 is a flowchart showing a method of controlling a cleaning apparatus according to an embodiment, when a robot cleaner moves to a docking station.

FIG. 20 is a flowchart showing a method of controlling a cleaning apparatus 1 according to an embodiment when a robot cleaner 10 moves to a docking station 20.

Referring to FIG. 20, the cleaning apparatus 1 according to an embodiment may, upon the amount of foreign substances collected in the dust container 161 being greater than a set amount (YES in operation 2010), control the robot cleaner 10 to move to the docking station 20 (2020).

Specifically, the robot cleaner 10 may, upon the amount of foreign substances collected in the dust container 161 reaching a preset amount, which is detected based on the output of the trapping portion sensor 120, move to the docking station 20.

The cleaning apparatus 1 according to an embodiment may, upon the robot cleaner 10 being coupled to the docking station 20 (YES operation in 2030), control to perform a discharge process (2040).

The robot cleaner 10 may determine that the robot cleaner 10 is coupled to the docking station 20, based on the output of at least one of the position detection sensor 110 of the robot cleaner 10, the position detection sensor 210 of the docking station 20, or the charging terminal 26 of the docking station 20.

The robot cleaner 10 may, upon the robot cleaner 10 being coupled to the docking station 20, initiate the discharge process. In this case, the robot cleaner 10 may transmit a control command for opening the dust container door 164 to the docking station 20, and the docking station 20 may open the dust container door 164.

In addition, the robot cleaner 10 may control the first suction device 140 to perform the discharge process, and transmit a control command regarding the second suction device 250 to the docking station 20.

In addition, the robot cleaner 10 may, based on a preset period of time $T_a$ elapsing after the initiation of the discharge process, end the discharge process. In this case, the robot cleaner 10 may transmit a control command for closing the dust container door 164 to the docking station 20, and the docking station 20 may close the dust container door 164.

Figure 21:
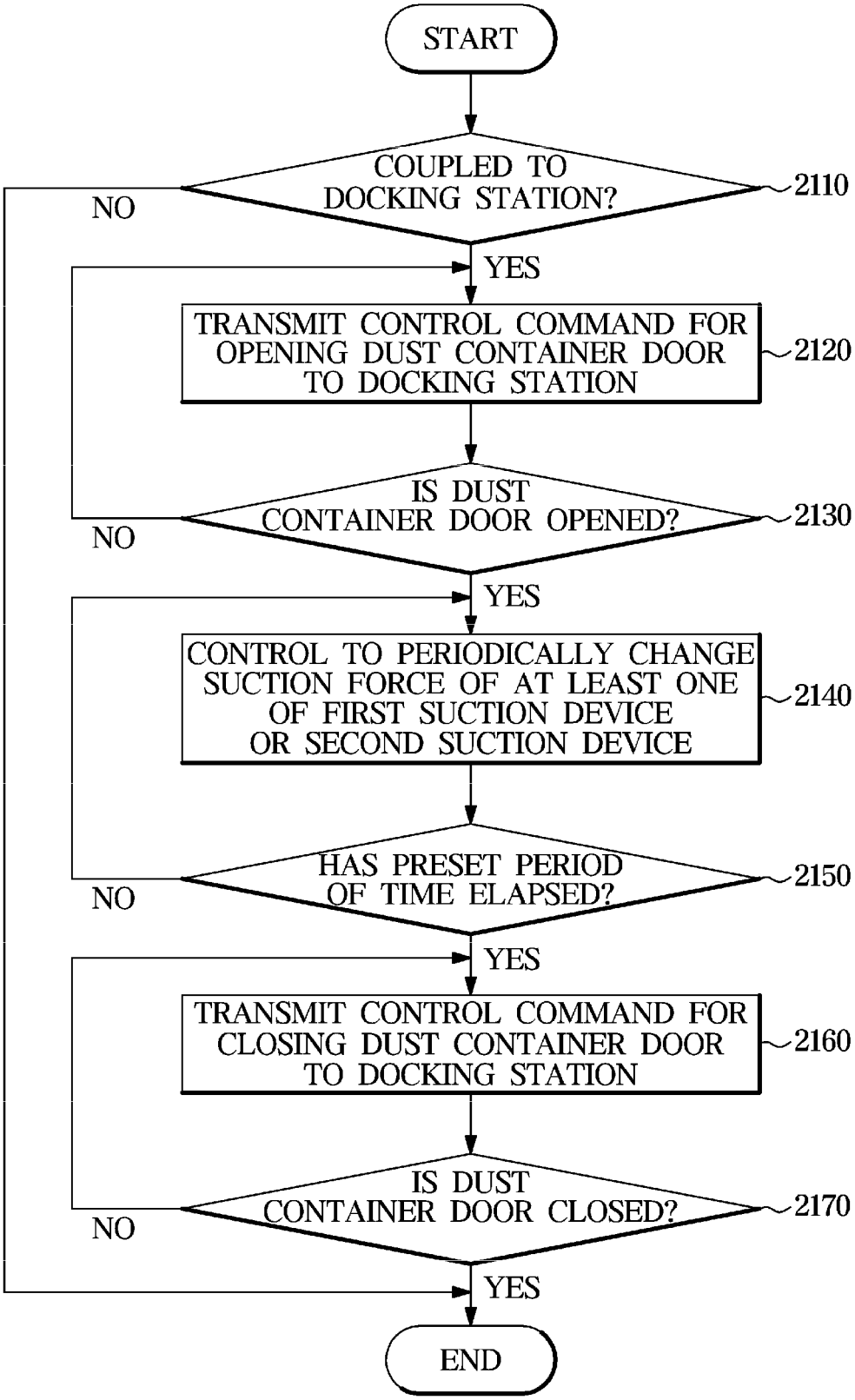
FIG. 21 is a flowchart showing a method of controlling a cleaning apparatus according to an embodiment, when a discharge process is performed by changing a suction force of at least one of a first suction device or a second suction device.

FIG. 21 is a flowchart showing a method of controlling a cleaning apparatus 1 according to an embodiment, when a discharge process is performed by alternately operating a first suction device 140 or a second suction device 250.

Referring to FIG. 21, the cleaning apparatus 1 according to an embodiment may, upon the robot cleaner 10 being coupled to the docking station 20 (YES in operation 2110), transmit a control command for opening the dust container door 164 to the docking station 20 (2120).

In this case, the robot cleaner 10 may transmit a control command for opening the dust container door 164 to the docking station 20, and the docking station 20 may open the dust container door 164.

The cleaning apparatus 1 according to an embodiment may, upon the dust container door 164 being opened (YES in operation 1830), control to periodically change the suction force of at least one of the first suction device 140 or the second suction device 250 (2140).

To this end, the robot cleaner 10 may control the first suction device 140 and control the communicator 150 to transmit a control command to the docking station 20 so that the suction force of at least one of the first suction device 140 of the robot cleaner 10 or the second suction device 250 of the docking station 20 is periodically changed. In this case, the controller 130 may allow the suction force of at least one of the first suction device 140 or the second suction device 250 to be periodically changed for a preset period of time $T_a$.

When the second suction device 250 of the docking station 20 is continuously powered on and the same intake airflow is supplied to the dust container 161, some of the foreign substances may be caught with internal components of the dust container 161 and may not be discharged to the outside. For example, foreign substances, such as hair, may be caught with internal components of the dust container 161 and despite the intake airflow, remain inside the dust container 161 without being separated from the outside of the dust container 161. That is, the intake airflow delivered to the inside of the dust container 161 may be formed only in the same direction. Accordingly, some foreign substances may have a resistance to the direction in which the intake airflow is formed, and thus may not escape to the outside of the dust container 161 by the intake airflow. Therefore, foreign substances inside the dust container 161 may not be effectively discharged.

Accordingly, the cleaning apparatus 1 may periodically change the suction force of at least one of the first suction device 140 of the robot cleaner 10 or the second suction device 250 of the docking station 20 while the discharge process is being performed to cause a change in the intake airflow, to change the flow rate inside the dust container 161, thereby varying the flow of air inside the dust container 161. As the internal pressure of the dust container 161 fluctuates, foreign substances in the dust container 161 may be discharged more efficiently.

The cleaning apparatus 1 according to an embodiment may, based on a preset period of time elapsing (YES in operation 2150), transmit a control command for closing the dust container door 164 to the docking station 20(2260), and upon the dust container door 164 being closed (YES in operation 2270), terminate the discharge process.

That is, the robot cleaner 10 may, based on a preset period of time $T_a$ elapsing after the initiation of the discharge process, end the discharge process. In this case, the robot cleaner 10 may transmit a control command for closing the dust container door 164 to the docking station 20, and the docking station 20 may close the dust container door 164.

Figure 22:
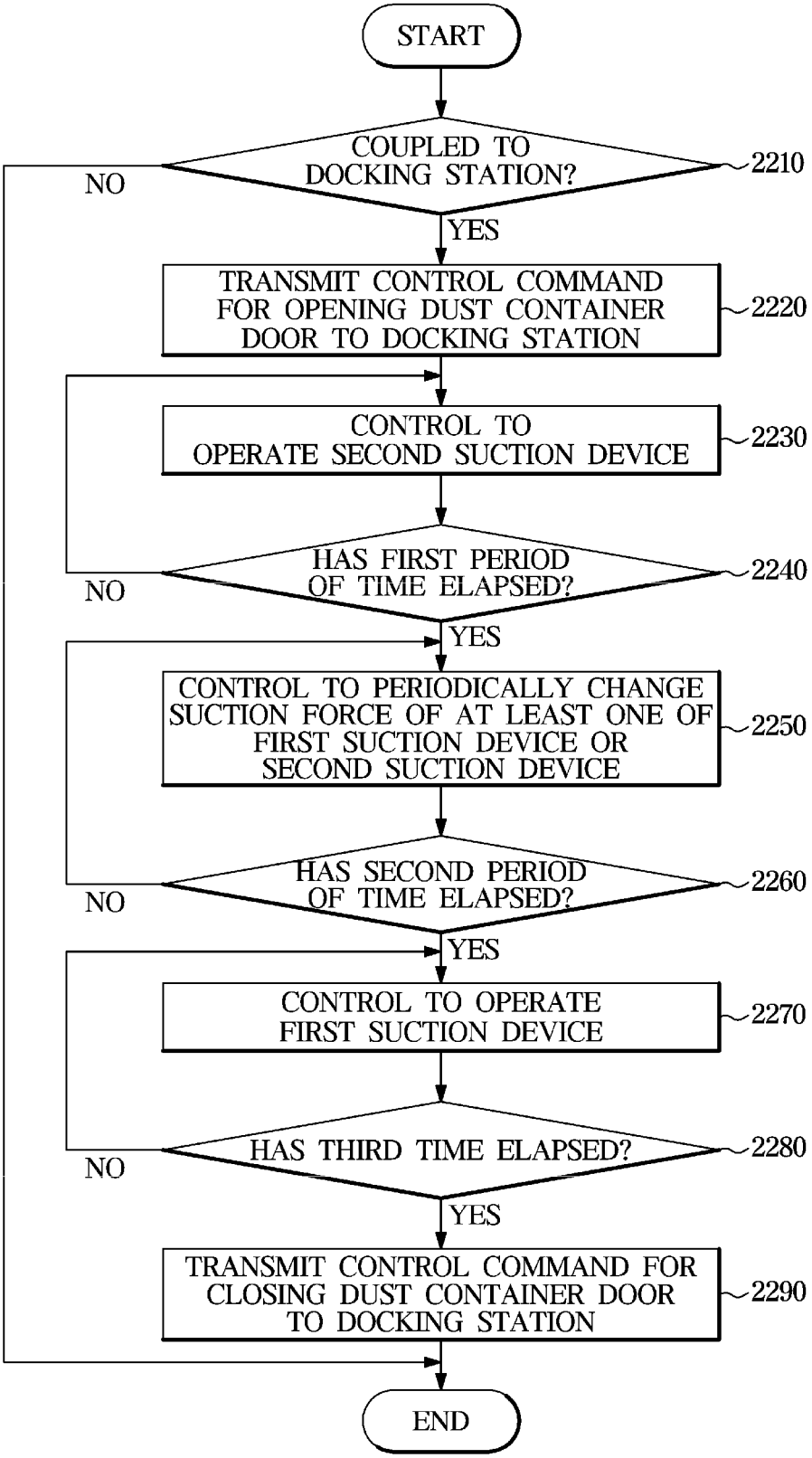
FIG. 22 is a flowchart showing a method of controlling a cleaning apparatus according to an embodiment, when foreign substances are collected back by operating a first suction device.

FIG. 22 is a flowchart a method of controlling a cleaning apparatus 1 according to an embodiment, when foreign substances are collected back by operating a first suction device 140.

Referring to FIG. 22, the cleaning apparatus 1 according to an embodiment may, upon the robot cleaner 10 being coupled to the docking station 20 (YES in operation 2210), transmit a control command for opening the dust container door 164 to the docking station 20 (2220).

The cleaning apparatus 1 according to an embodiment may, upon the dust container door 164 being opened, control to operate the second suction device 250 (2230).

That is, the cleaning apparatus 1 according embodiments may, in response to an initiation of a discharge process, allow the second suction device 250 to preferentially operate for a preset period of time $T_{a1}$ before the suction force of at least one of the first suction device 140 of the robot cleaner 10 or the second suction device 250 of the docking station 20 is periodically changed.

To this end, the robot cleaner 10 according to embodiments may, upon the robot cleaner 10 being coupled to the docking station 20, control the communicator 150 to transmit a control command for the second suction device 250 to operate for a preset period of time $T_{a1}$ to the docking station 20 before the suction force of at least one of the first suction device 140 or the second suction device 250 is periodically changed. The second suction device 250 according to embodiments may operate for the preset period of time $T_{a1}$ before the suction force of at least one of the first suction device 140 or the second suction device 250 is periodically changed, to suction foreign substances and/or air from the dust container 161.

With such a configuration, the cleaning apparatus 1 may allow foreign substances to be preferentially discharged from the dust container 161 to the docking station 20, and then, in order for foreign substances remaining in the dust container 161 to be more efficiently discharged, periodically change the suction force of at least one of the first suction device 140 of the robot cleaner 10 or the second suction device 250 of the docking station 20.

The cleaning apparatus 1 according to an embodiment may, based on the first period of time elapsing (YES in operation 2240), control to periodically change the suction force of at least one of the first suction device 140 or the second suction device 250 (1250), and based on a second period of time elapsing (YES in operation 1260), control the first suction device 140 to operate (1270).

That is, the cleaning apparatus 1 may control the first suction device 140 such that only the first suction device 140 operates for a preset period of time $T_{a3}$ after the suction force of at least one of the first suction device 140 or the second suction device 250 is periodically changed.

In other words, the robot cleaner 10 according to embodiments may control the first suction device 140 such that only the first suction device 140 operates for a preset period of time $T_{a3}$ while the second suction device 250 is not in operation after the suction force of at least one of the first suction device 140 or the second suction device 250 is periodically changed.

Therefore, the first suction device 140 according to embodiments operates for the third time such that foreign substances remaining between the dust container 161 and the dust container door for opening and closing the dust container 161 are collected back to the dust container 161. Accordingly, the foreign substances d positioned between the dust container 161 and the dust container door 164 may move into the dust container 161.

With such a configuration, deterioration of sealing of the dust container 161 that may occur due to foreign substances remaining between the dust container 161 and the dust container door 164 may be prevented, thus preventing air from flowing through a region between the dust container 161 and the dust container door 164 and finally preventing the suction force of the robot cleaner 10 from being reduced. In addition, foreign substances (e.g., hair) remaining between the dust container 161 and the dust container door 164 may be prevented from being exposed to the outside of the robot cleaner 10, thereby preventing a user from feeling displeasure.

The cleaning apparatus 1 according to an embodiment may, based on the third time elapsing (YES in operation 2280), transmit a control command for closing the dust container door 164 to the docking station 20 (2290).

Meanwhile, the disclosed embodiments may be embodied in the form of a recording medium storing instructions executable by a computer. The instructions may be stored in the form of program code and, when executed by a processor, may generate a program module to perform the operations of the disclosed embodiments. The recording medium may be embodied as a computer-readable recording medium.

The computer-readable recording medium includes all kinds of recording media in which instructions which may be decoded by a computer are stored, for example, a Read Only Memory (ROM), a Random Access Memory (RAM), a magnetic tape, a magnetic disk, a flash memory, an optical data storage device, and the like.

Although embodiments of the present disclosure have been described for illustrative purposes, those skilled in the art will appreciate that various modifications, additions and substitutions are possible, without departing from the scope and spirit of the disclosure. Therefore, embodiments of the present disclosure have not been described for limiting purposes.

What is claimed is:

1. A cleaning apparatus comprising:

a robot cleaner including a dust container and a first suction device; and a docking station including:

a second suction device configured to, in response to the robot cleaner being coupled to the docking station, communicate with the dust container, and suck air including foreign substances from the dust container; and a trapping portion configured to capture the foreign substances included the sucked air, wherein the robot cleaner includes:

a communicator; and a controller configured to, in response to the robot cleaner being coupled to the docking station, initiate a discharge process of the dust container including controlling the first suction device, and controlling the communicator to transmit a control command to the docking station, so that a suction force of at least one of the first suction device and the second suction device is periodically changed while the discharge process is being performed to vary a flow of air inside the dust container.

2. The cleaning apparatus of claim 1, wherein the controller is configured to, in response to the robot cleaner being coupled to the docking station, control the communicator to transmit a control command for the second suction device to operate for a first period of time to the docking station.

3. The cleaning apparatus of claim 2, wherein the controller is configured to, after the second suction device operates for the first period of time, periodically change the suction force of the at least one of the first suction device and the second suction device.

4. The cleaning apparatus of claim 1, wherein the controller is configured to control the first suction device so that the first suction device operates for a second period of time after the suction force of the at least one of the first suction device and the second suction device is periodically changed.

5. The cleaning apparatus of claim 1, wherein the controller is configured to periodically change the suction force of each of the first suction device and the second suction device so that the first suction device and the second suction device operate alternately with each other.

6. The cleaning apparatus of claim 1, wherein the controller is configured to periodically change the suction force of the second suction device while the first suction device is stopped.

7. The cleaning apparatus of claim 1, wherein the controller is configured to periodically change the suction force of the second suction device while the first suction device is continuously turned on.

8. The cleaning apparatus of claim 1, wherein the controller is configured to periodically change the suction force of the first suction device while the second suction device is continuously turned on.

9. The cleaning apparatus of claim 1, wherein the robot cleaner includes a dust container door to open or close the dust container, and the docking station includes a lever device configured to open the dust container door to allow the dust container to communicate with the second suction device.

10. The cleaning apparatus of claim 9, wherein the controller is configured to, in response to the robot cleaner being coupled to the docking station, control the communicator to transmit a control command for the lever device to open the dust container door to the docking station.

11. The cleaning apparatus of claim 9, wherein the controller is configured to control the communicator to transmit, to the docking station, a control command for the lever device to close the dust container door after the suction force of the at least one of the first suction device and the second suction device is periodically changed.

12. The cleaning apparatus of claim 1, wherein the robot cleaner further includes a dust container sensor configured to measure an amount of foreign substances collected in the dust container, wherein the controller is configured to, in response to determining that the amount of the foreign substances collected in the dust container reaching a preset amount based on an output of the dust container sensor, allow the robot cleaner to move to the docking station.

13. A method of controlling a cleaning apparatus including a robot cleaner including a dust container and a first suction device, and a docking station including a second suction device configured to, in response to the robot cleaner being coupled to the docking station, communicate with the dust container and suck air including foreign substances from the dust container, the method comprising:

in response to the robot cleaner being coupled to the docking station, initiating a discharge process of the dust container including controlling the first suction device, and controlling the robot cleaner to transmit a control command to the docking station, so that a suction force of at least one of the first suction device and the second suction device is periodically changed while the discharge process is being performed to vary a flow of air inside the dust container.

14. The method of claim 13, further comprising, in response to the robot cleaner being coupled to the docking station, controlling the robot cleaner to transmit a control command for the second suction device to operate for a first period of time to the docking station.

15. The method of claim 14, wherein the periodical changing of the suction force of the at least one of the first suction device and the second suction device includes, after the second suction device operates for the first period of time, periodically changing the suction force of the at least one of the first suction device and the second suction device.

* * * * *